US008884555B2

(12) United States Patent
Nagumo

(10) Patent No.: US 8,884,555 B2
(45) Date of Patent: Nov. 11, 2014

(54) LIGHT-EMITTING ELEMENT ARRAY, DRIVING DEVICE, AND IMAGE FORMING APPARATUS

(75) Inventor: Akira Nagumo, Tokyo (JP)

(73) Assignee: Oki Data Corporation, Tokyo (JP)

( * ) Notice: Subject to any disclaimer, the term of this patent is extended or adjusted under 35 U.S.C. 154(b) by 170 days.

(21) Appl. No.: 13/571,056

(22) Filed: Aug. 9, 2012

(65) Prior Publication Data

US 2012/0301164 A1 Nov. 29, 2012

Related U.S. Application Data

(62) Division of application No. 12/458,997, filed on Jul. 29, 2009, now Pat. No. 8,258,723.

(30) Foreign Application Priority Data

Aug. 1, 2008 (JP) ..... 2008-199604

(51) Int. Cl.
*H05B 37/00* (2006.01)

(52) U.S. Cl.
USPC ..... 315/313

(58) Field of Classification Search
CPC ..... B41J 2/45; B41J 2002/453; B41J 2/451; B41J 2/1752; B41J 2/17546; H01L 2924/00; H01L 27/153; H01L 2224/48091; H01L 2224/45124; H01L 27/15; H01L 2924/10253
USPC ..... 315/312, 313; 347/128, 130, 238; 399/220
See application file for complete search history.

(56) References Cited

U.S. PATENT DOCUMENTS

| | | | |
|---|---|---|---|
| 6,717,183 | B2 | 4/2004 | Ohno et al. |
| 7,923,737 | B2 | 4/2011 | Nagumo |
| 7,924,304 | B2 | 4/2011 | Nagumo |
| 7,990,407 | B2 | 8/2011 | Nagumo |
| 2001/0010510 | A1 | 8/2001 | Ohno |
| 2002/0134930 | A1 | 9/2002 | Ohno |
| 2003/0058329 | A1 | 3/2003 | Ohno |
| 2003/0071274 | A1 | 4/2003 | Ohno et al. |
| 2004/0159844 | A1 | 8/2004 | Tagami et al. |
| 2005/0087748 | A1 * | 4/2005 | Ohno ..... 257/88 |
| 2007/0057259 | A1 | 3/2007 | Nagumo |
| 2009/0166646 | A1 | 7/2009 | Ohno |
| 2009/0237483 | A1 | 9/2009 | Nagumo |
| 2009/0295901 | A1 | 12/2009 | Nagumo |
| 2010/0118108 | A1 | 5/2010 | Ohno |
| 2011/0007124 | A1 | 1/2011 | Furuta et al. |

FOREIGN PATENT DOCUMENTS

| | | |
|---|---|---|
| JP | 2001-219596 A | 8/2001 |
| JP | 2007-081081 A | 3/2007 |

* cited by examiner

*Primary Examiner* — Thienvu Tran
(74) *Attorney, Agent, or Firm* — Rabin & Berdo, P.C.

(57) ABSTRACT

A light-emitting element array has a plurality of three-terminal light-emitting elements such as light-emitting thyristors with anode, cathode, and gate terminals. The anode terminal of each light-emitting element is connected to a driving circuit. The cathode terminal is grounded. The gate terminals of at least some of the three-terminal light-emitting elements are driven from a common buffer, and within this group of three-terminal light-emitting elements, the anode terminals are driven individually. This enables the array of three-terminal light-emitting elements to be driven in essentially the same way as an array of two-terminal light-emitting elements, but without the need for large power transistors between the cathode terminals and ground.

16 Claims, 29 Drawing Sheets

LIGHT-EMITTING ELEMENT ARRAY, DRIVING DEVICE, AND IMAGE FORMING APPARATUS

This application is a divisional application of U.S. application Ser. No. 12/458,997, filed Jul. 29, 2009, which claims the benefit of Japan application Serial No. JP 2008-199604, filed Aug. 1, 2008. These related applications are incorporated herein by reference.

BACKGROUND OF THE INVENTION

1. Field of the Invention

The present invention relates to a light-emitting element array, a driving device for driving the light-emitting element array, and an image forming apparatus for forming images by using the light-emitting element array and driver device.

2. Description of the Related Art

In some conventional electrophotographic image forming apparatus, including some electrophotographic printers, an array of light-emitting elements selectively illuminates a charged photosensitive drum to form a latent image, which is developed by application of toner to form a toner image, and the toner image is transferred to and fused onto a sheet of paper.

The light-emitting elements and their driving circuits may be disposed on separate substrates, which are placed side by side and are electrically interconnected by bonding wires. In an electrophotographic printer using light-emitting diodes (LEDs) as light-emitting elements, the driving circuits switch the light-emitting elements on and off by feeding or not feeding current between the anode and cathode terminals of each LED. The driving scheme of an exemplary LED optical print head will be described below.

This LED optical print head is a typical head capable of printing on A4 paper with a resolution of 600 dots per inch. This requires a linear array of 4,992 LEDs, to print lines of 4,992 dots. These LEDs are disposed in twenty-six LED array chips, each including 192 LEDs. The cathodes of the odd-numbered LEDs are interconnected, the cathodes of the even-numbered LEDs are interconnected, and the anodes of mutually adjacent pairs of LEDs are interconnected, enabling the odd-numbered LEDs and the even-numbered LEDs to be driven alternately.

In FIG. 1, CHP1 and CHP2 are the first two LED array chips; the other LED array chips (CHP3 to CHP26) are not shown. Each LED array chip is driven by a separate driver integrated circuit (IC); the first two driver ICs (IC1 and IC2) are shown and the rest (IC3 to IC26) are omitted. The driver ICs have data terminals, which are connected in cascade to enable dot data to be passed from one driver IC to the next.

The LED array includes the LEDs 31 to 38 on the LED array chips and two power metal-oxide-semiconductor (MOS) transistors 41 and 42. The drain of power MOS transistor 41 is connected to the cathodes of the odd-numbered LEDs 31, 33, 35, 37; the drain of power MOS transistor 42 is connected to the even-numbered LEDs 32, 34, 36, 38. The source terminals of the power MOS transistors 41, 42 are grounded. The gate of power MOS transistor 41 is connected to a cathode driving (KDRV) terminal of driver IC1 and receives a signal denoted ODD; the gate of power MOS transistor 42 is connected to the KDRV terminal of driver IC2 and receives a signal denoted EVEN.

The driver ICs have data input terminals (DATAI3 to DATAI0) for receiving four-bit parallel print data signals (HD-DATA) in synchronization with a clock signal (HD-CLK). The first driver IC (IC1) receives these signals from a printing control unit (not visible); the other driver ICs receive the print data signals from the data output terminals (DATAO3 to DATAO0) of the preceding driver IC, and the other signals from the printing control unit. The four bits of print data received with each clock pulse pertain to the four odd-numbered LEDs or four even-numbered LEDs in a group of eight consecutive LEDs. The driver ICs have internal flip-flops (not visible) that form a shift register for holding bit data for 2,496 dots, and latch circuits (not shown) into which the data are loaded from the shift register in synchronization with a latch signal (HD-LOAD). The latched data are output in synchronization with a strobe signal (HD-STB-N) to drive the LEDs in the LED array chips with driving current regulated by a reference voltage VREF received from a reference voltage generating circuit (not shown). A synchronizing signal HD-SYNC-N determines whether the even-numbered or odd-numbered LEDs are driven. The driver ICs also have power supply (VDD) and ground (GND) terminals for receiving power.

The reason for driving the even-numbered or odd-numbered LEDs separately is to avoid the large flow of current that might occur if all the LEDs were to be driven simultaneously. The power MOS transistors 41, 42 in this conventional LED print head are required by the separate even-odd driving scheme. When the odd-numbered LEDs are driven, power MOS transistor 41 is switched on by the ODD signal to allow current to flow through the odd-numbered LEDs. When the even-numbered LEDs are driven, power MOS transistor 42 is switched on by the EVEN signal to allow current to flow through the even-numbered LEDs.

Even though at most only half of the LEDs are driven at once, the power MOS transistors 41, 42 must still be capable of switching considerable amounts of current. The power MOS transistors 41, 42 themselves are therefore necessarily large in size and take up considerable space in the LED print head. The power MOS transistor chips and the extra space needed for mounting them add to the cost of the materials used in the print head. The presence of these power MOS transistors is a major obstacle to reducing the size and cost of the print head.

In an electrophotographic printer proposed by the present inventor in U.S. Patent Application Publication No. 2007/0057259 (counterpart of Japanese Patent Application Publication No. 2007-81081), the need for these power MOS transistors is avoided by using light-emitting thyristors as light-emitting elements. The light-emitting thyristors are connected to a common current driving line and their gate terminals are driven individually, one by one, according to the print data. This driving scheme is, however, quite different from the conventional LED array driving scheme.

SUMMARY OF THE INVENTION

An object of the present invention is to reduce the size and cost of an optical printing head.

A further object is to reduce the size and cost of an optical printing head without greatly altering conventional driving methods.

The invention provides a light-emitting element array having a plurality of three-terminal light-emitting elements such as light-emitting thyristors. The first terminal of each light-emitting element is connected through a driving circuit to a first potential. The second terminal is connected to a second potential. The potential at the third terminal enables the current flow between the first and second terminals to begin, or prevents it from beginning.

The third terminals of a plurality of the three-terminal light-emitting elements are driven in common. The first terminals of this plurality of the three-terminal light-emitting elements are driven individually, in that the first terminal of each of these three-terminal light-emitting thyristors is driven separately from the first terminals of all other three-terminal light-emitting elements in this plurality of three-terminal light-emitting thyristors.

The third terminals are preferably driven by being switchably connected to the first and second potentials, the connection to the second potential passing through a self-opening switching element that switches off when the third terminal is at a potential differing from the second potential by less than a predetermined amount.

The invention also provides a driving device using a first potential and a second potential to drive an array of three-terminal elements each having a first terminal, a second terminal connected to the second potential, and a third terminal for enabling current flow between the first terminal and the second terminal. The driving device includes a plurality of switchable current sources connected to the first potential, for feeding current to the first terminals of the three-terminal elements, and a switching circuit for switchably connecting the third terminals of the three-terminal elements to the first and second potentials. The switching circuit includes a common buffer that switches potentials at the third terminals of a plurality of the three-terminal light-emitting elements simultaneously.

The invention also provides an image forming apparatus including the above light-emitting element array and the above driving device.

By using the third terminals of the three-terminal light-emitting elements to select groups of light-emitting elements that can emit light simultaneously, the novel array of three-terminal light-emitting elements eliminates the need for the power MOS transistors of a conventional LED array, reducing the size and cost of the array.

If the third terminals of the three-terminal light-emitting elements are connected to the second potential through self-opening switching elements that switch off when the potentials of the third terminals approach the second potential, the three-terminal light-emitting elements can be driven in essentially the same way as the LEDs in a conventional LED array. The switching circuit that drives the third terminals can be integrated into the driving device. The driving device can be implemented by making only comparatively slight modifications to a driving device for a conventional LED array.

An image forming device incorporating the present invention can accordingly be smaller than an equivalent image forming device using LEDs, can be implemented easily, and can be manufactured at a comparatively low cost.

DETAILED DESCRIPTION OF THE INVENTION

Figure 1:
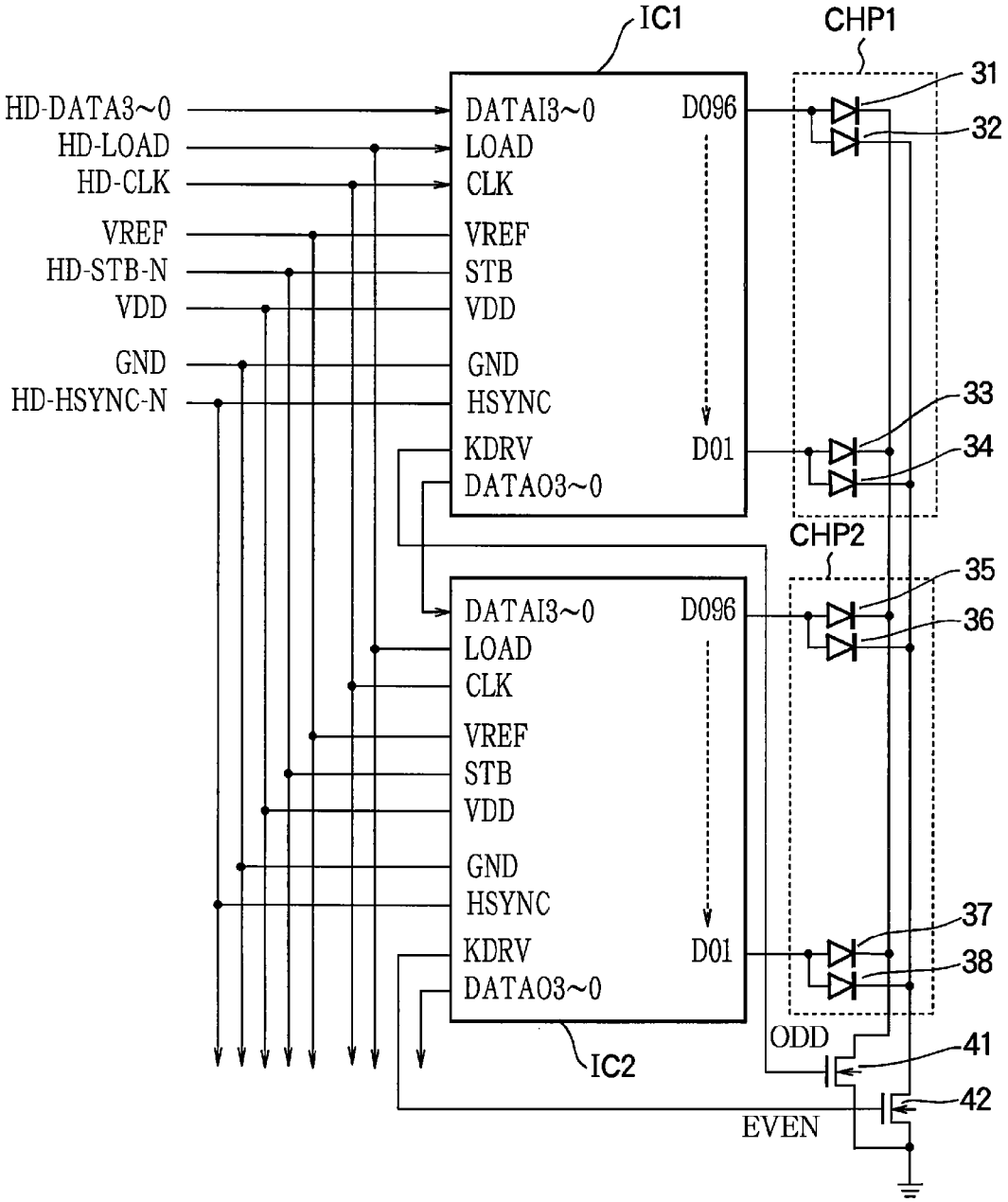
FIG.1 PRIOR ART
FIG. 1 is a schematic circuit diagram illustrating a conventional LED optical print head.

Embodiments of the invention will now be described with reference to the attached drawings, in which like elements are indicated by like reference characters. Reference will be made to well-known semiconductor fabrication processes such as photolithography, etching, dicing, and metal organic chemical vapor deposition (MO-CVD), which will not be described in detail.

Figure 2:
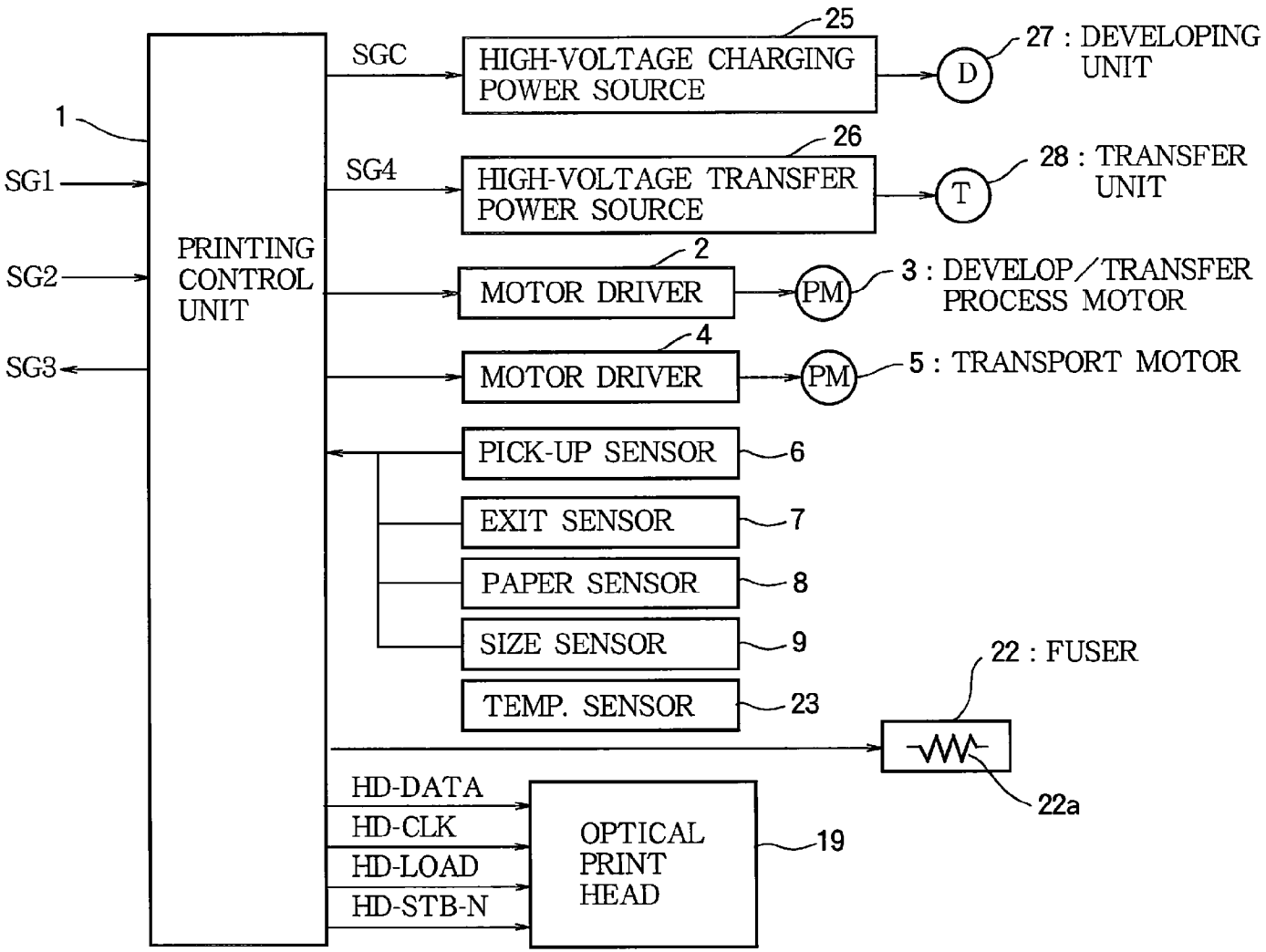
FIG. 2 is a block diagram of an electrophotographic printer embodying the present invention.

The embodiments are electrophotographic printers including the elements illustrated in FIG. 2. These elements include a printing control unit 1 having a microprocessor, read-only memory (ROM), random-access memory (RAM), input-output ports, timers, and other well-known facilities (not shown). Upon receiving signals SG1, SG2, etc. from a higher-order controller (not shown), the printing control unit 1 generates signals that control a sequence of operations for printing dot-mapped data. The data are provided in signal SG2, which is sometimes referred to as a video signal because it supplies the dot-mapped data one-dimensionally.

The printing sequence starts when the printing control unit 1 receives a printing command from the higher-order controller by means of control signal SG1. First, a temperature (Temp.) sensor 23 is checked to determine whether a fuser 22 is at the necessary temperature for printing. If it is not, current is fed to a heater 22*a* to raise the temperature of the fuser 22.

In addition, a paper sensor 8 is checked to confirm that paper is present in a cassette (not visible), and a size sensor 9 is checked to determine the size of the paper. If paper is present, a motor driver 4 drives a paper transport motor (PM) 5 according to the size of the paper, first in one direction to transport the paper to a starting position sensed by a pick-up sensor 6, then in the opposite direction to transport the paper into the printing mechanism.

When the paper is in position for printing, the printing control unit 1 sends the higher-order controller a timing signal SG3 (including a main scanning synchronization signal and a sub-scanning synchronization signal). The higher-order controller responds by sending the dot data for one page in the video signal SG2. The printing control unit 1 sends corresponding dot data (HD-DATA) to an optical print head 19 in synchronization with a clock signal (HD-CLK). The optical print head 19 comprises a linear array of light-emitting thyristors for printing respective dots (also referred to as picture elements or pixels).

After receiving data for one line of dots in the video signal SG2 and sending the data to the optical print head 19, the printing control unit 1 sends the optical print head 19 a latch signal (HD-LOAD), causing the optical print head 19 to store the print data (HD-DATA). The print data stored in the optical print head 19 can then be printed while the printing control unit 1 is receiving the next print data from the higher-order controller in the video signal SG2.

The video signal SG2 is transmitted and received one printing line at a time. For each line, the optical print head 19 forms a latent image of dots with a comparatively high electric potential on a negatively charged photosensitive drum (not visible). In a developing unit (D) 27, negatively charged toner is electrically attracted to the dots, forming a toner image. The drum and toner are charged by a high-voltage charging power source 25.

The toner image is then transported to a transfer unit (T) 28. The printing control unit 1 activates a high-voltage transfer power source 26 by sending it a transfer signal SG4, and the toner image is transferred to a sheet of paper passing between the photosensitive drum and transfer unit 28. The sheet of paper carrying the transferred toner image is transported to the fuser 22, where the toner image is fused onto the paper by heat generated by the heater 22*a*. Finally, the sheet of paper carrying the fused toner image is transported out of the printing mechanism, passing an exit sensor 7, and ejected from the printer.

The printing control unit 1 controls the high-voltage transfer power source 26 according to the information detected by the pick-up sensor 6 and size sensor 9 so that voltage is applied to the transfer unit 28 only while paper is passing through the transfer unit 28. When the paper passes the exit sensor 7, the printing control unit 1 stops the supply of voltage from the high-voltage charging power source 25 to the developing unit 27, and halts the turning of the photosensitive drum and various rollers (not shown) by controlling a motor driver 2 that drives a develop/transfer process motor 3. The above operations are repeated to print a series of pages.

First Embodiment

An optical print head according to a first embodiment will be described with reference to FIG. 3. The description below concerns an exemplary optical print head capable of printing on A4 paper with a resolution of 600 dots per inch, having a total of 4,992 light-emitting thyristors disposed in twenty-six array chips, each including 192 light-emitting thyristors. In the light-emitting thyristor array chips, the cathodes of the light-emitting thyristors are interconnected, and the anodes of mutually adjacent pairs of light-emitting thyristors are interconnected. The gate terminals of the odd-numbered light-emitting thyristors are interconnected, and the gate terminals of the even-numbered light-emitting thyristors are interconnected, enabling the odd- and even-numbered light-emitting thyristors to be driven alternately.

CHP1 and CHP2 are light-emitting thyristor array chips; the other array chips CHP3 to CHP26 are not shown. Each light-emitting thyristor array chip is driven by a separate driver integrated circuit (IC); the first two driver ICs IC1 and IC2 are shown and the rest (IC3 to IC26) are omitted. The driver ICs are mutually identical and are connected in cascade. Each light-emitting thyristor array chip includes 192 light-emitting thyristor elements, of which light-emitting thyristors 101 to 108 are shown in FIG. 3. Each light-emitting thyristor has a first terminal or anode, a second terminal or cathode, and a third terminal or gate. The anodes of mutually adjacent pairs of light-emitting thyristors are connected to anode driving terminals DO1 to DO96 of the corresponding driver IC. The cathodes of the light-emitting thyristors are grounded. The gates of the odd-numbered light-emitting thyristors are connected to a gate driving terminal G1 on the corresponding driver IC. The gates of the even-numbered light-emitting thyristors are connected to a gate driving terminal G2 on the corresponding driver IC.

For example, the anodes of light-emitting thyristors 101 and 102 in the first array chip CHP1 are both connected to anode driving terminal DO96 of the first driver IC (IC1). Similarly, the anodes of light-emitting thyristors 103 and 104 are both connected to anode driving terminal DO1. The cathodes of light-emitting thyristors 101, 102, 103, and 104 are commonly grounded. The gates of light-emitting thyristors 101 and 103 are interconnected and are connected to gate driving terminal G1 on the first driver IC (IC1). The gates of light-emitting thyristors 102 and 104 are interconnected and are connected to gate driving terminal G2.

The driver ICs have data input terminals (DATAI3 to DATAI0) for receiving four-bit parallel print data signals (HD-DATA3 to HD-DATA0) in synchronization with a clock signal (HD-CLK) from the printing control unit 1. The four bits received with each clock pulse pertain to the four odd-numbered dots or four even-numbered dots in a group of eight consecutive dots. The driver ICs have internal flip-flops that form a shift register for holding the print data for 2,496 dots, and latch circuits into which the print data are loaded from the shift register in synchronization with a latch signal (HD-LOAD). Following input of a synchronizing pulse (HD-SYNC-N), first all the odd-numbered dot data are shifted in and latched; then all the even-numbered dot data are shifted in and latched.

After the even or odd dot data have been latched, the even or odd light-emitting thyristors in the light-emitting thyristor array chips are driven according to the latched dot data in synchronization with a strobe signal (HD-STB-N). The driving current is controlled with reference to a reference voltage VREF received from an external reference voltage generating circuit (not shown). The driver ICs also have power supply (VDD) and ground (GND) terminals for receiving power from a power supply circuit (not shown).

Figure 4:
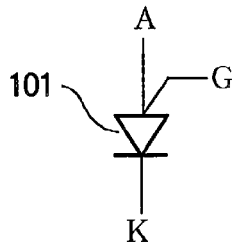
FIGS. 4 to 7 illustrate the structure of the light-emitting thyristors in the first embodiment.
Figure 5:
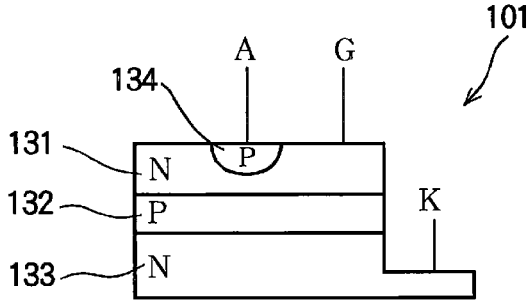

FIG. 4 shows the circuit symbol of a light-emitting thyristor, e.g., light-emitting thyristor 101, indicating its anode A, cathode K, and gate G. FIG. 5 shows a schematic sectional view of the light-emitting thyristor 101. The light-emitting thyristor is fabricated on a gallium arsenide (GaAs) wafer substrate by growing epitaxial crystalline layers on the substrate by MO-CVD.

After a buffer layer and a sacrificial layer (not shown) are grown, a three-layer NPN structure is formed in which the top N-type layer 131 is an aluminum gallium arsenide (AlGaAs) layer doped with an N-type impurity, the middle P-type layer 132 is an AlGaAs layer doped with a P-type impurity, and the bottom N-type layer 133 is an AlGaAs layer doped with an N-type impurity. A P-type region 134 is formed in part of the top N-type layer 131 by selective doping with a P-type impurity through a mask (not shown) defined by photolithography. The individual thyristor elements in the array are isolated by trenches formed by dry etching. The etching process exposes part of the bottom N-type layer 133. A cathode electrode K is formed by metalizing that part of the bottom N-type layer 133. At the same time, an anode electrode A is formed on the P-type region 134 and a gate electrode G is formed on the top N-type layer 131.

Figure 6:
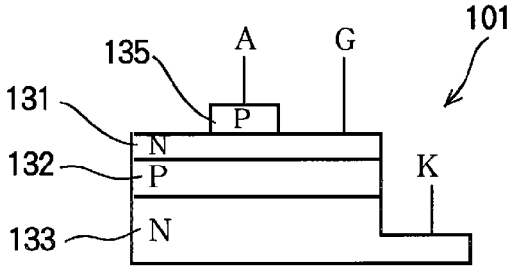

FIG. 6 shows an alternative light-emitting thyristor structure, which also includes epitaxial crystal layers grown by MO-CVD on a GaAs wafer substrate (not shown). After a buffer layer and sacrificial layer (not shown) have been grown, a four-layer PNPN structure is formed in which the top N-type layer 131 is an AlGaAs layer doped with an N-type impurity, the middle P-type layer 132 is an AlGaAs layer doped with a P-type impurity, the bottom N-type layer 133 is an AlGaAs layer doped with an N-type impurity, and an additional AlGaAs layer doped with a P-type impurity is grown as a P-type layer 135 on the top N-type layer 131.

The thyristor element in FIG. 6 is also isolated by trenches formed by dry etching. The etching process exposes part of the N-type layer 133 at the bottom of the light-emitting thyristor, and a cathode electrode K is formed by metalizing that part of the N-type layer 133. The P-type layer 135 is also selectively etched to expose part of the N-type layer 131. An anode electrode A is formed by metalizing the remaining part of the P-type layer 135 at the top of the thyristor, and a gate electrode G is formed on the top N-type layer 131.

Figure 7:
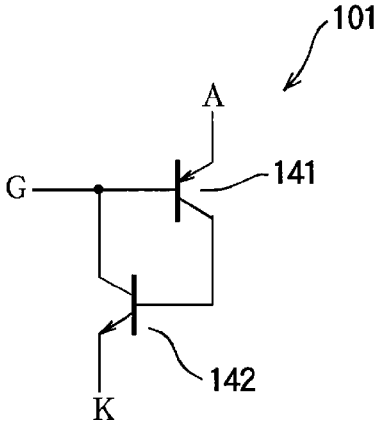

FIG. 7 shows an equivalent circuit of the light-emitting thyristors in FIGS. 5 and 6. Part of the light-emitting thyristor 101 operates as a PNP transistor 141 and an overlapping part operates as an NPN transistor 142. The thyristor anode A functions as the emitter of PNP transistor 141. The thyristor gate G functions as the base of PNP transistor 141 and also as the collector of NPN transistor 142. The collector of PNP transistor 141 also functions as the base of NPN transistor 142. The thyristor cathode K functions as the emitter of NPN transistor 142.

Although the light-emitting thyristors described above include epitaxial AlGaAs layers formed on a GaAs wafer substrate, other materials such as gallium phosphide (GaP), gallium arsenide phosphide (GaAsP), and aluminum gallium indium phosphide (AlGaInP) may be formed on a GaAs wafer substrate, or layers of materials such as gallium nitride (GaN) or aluminum gallium nitride (AlGaN) may be formed on a sapphire substrate.

Instead of being disposed in separate chips, the light-emitting thyristor arrays may bonded directly to the driver ICs (e.g., IC1 or IC2 in FIG. 3) by the epitaxial bonding method described in U.S. Patent Application Publication No. 2007/0057259. In this method, the driver ICs are formed on a silicon wafer and the light-emitting thyristors are formed on a compound semiconductor wafer. The light-emitting thyristors are then transferred from the compound semiconductor wafer to the silicon wafer, unnecessary parts being eliminated by etching an etching process that exposes the thyristor terminals, and the thyristor terminals are connected to the appropriate terminals of the driver ICs by thin-film wiring formed by photolithography. The silicon wafer is then diced into chips, each chip being a composite device including both silicon driver circuits and compound semiconductor light-emitting thyristors.

Figure 8:
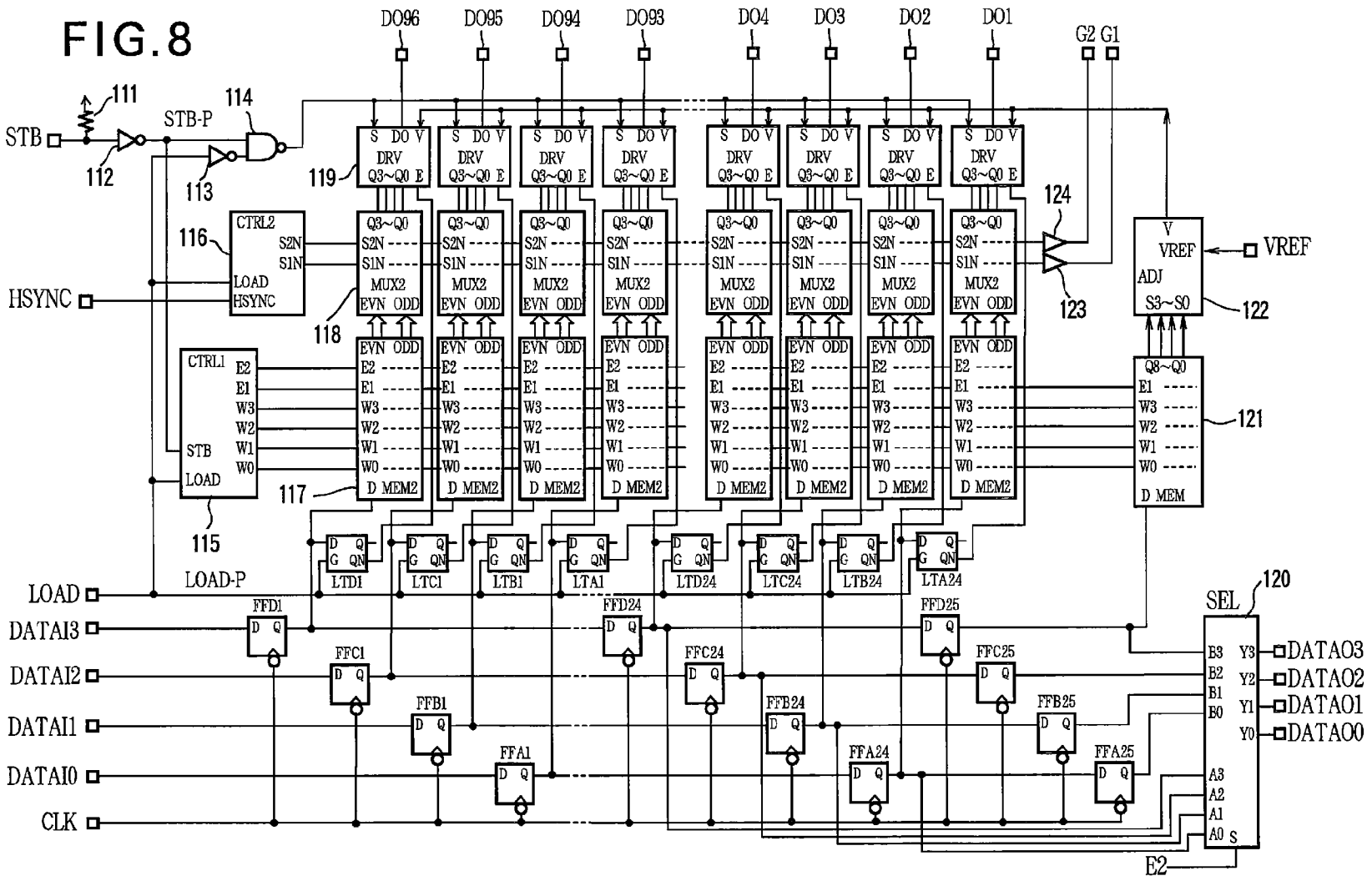
FIG. 8 is a block diagram showing the detailed structure of the driver ICs in the first embodiment.

FIG. 8 is a block diagram showing the detailed structure of the driver ICs in the first embodiment. Each driver IC includes: a pull-up resistor 111, connected between the strobe (STB) terminal and the power supply (VDD); a pair of inverters 112 and 113; a NAND circuit 114; flip-flops FFA1 to FFA25, FFB1 to FFB25, FFC1 to FFC25, and FFD1 to FFD25, interconnected to form a shift register; latch elements LTA1 to LTA24, LTB1 to LTB24, LTC1 to LTC24, and LTD1 to LTD24, all of which form a latch circuit; and memory circuits organized as a MEM block 121 and twenty-four MEM2 blocks 117. The MEM2 blocks 117 store dot compensation data that compensate for variations in light output between individual light-emitting thyristors. The MEM block 121 stores chip compensation data that compensate for variations in light output between the light-emitting thyristor array chips, or differences in electrical characteristics between the individual driver ICs.

For each pair of consecutive dots, the driver IC also includes a multiplexer circuit or MUX2 block 118 that switches between the dot compensation data output from the corresponding MEM2 block 117 for the odd-numbered dot and the even-numbered dot, and a DRV block 119 that includes the driving circuitry which supplies driving current to the cathodes of the light-emitting thyristors.

The driver IC also includes a selector circuit or SEL block 120 and a pair of control circuit blocks 115, 116 denoted CTR1 and CTRL2. The CTRL1 block 115 generates write command signals E1, E2, and W3 to W0 when compensation data are written in the memory (MEM2 or MEM) blocks. The selector circuit 120 selects signals input at terminals A0, A1, A2, A3 or signals input at terminals B0, B1, B2, B3 according to the E2 write command signal, and outputs the selected signals at terminals Y0, Y1, Y2, Y3. The CTRL2 block 116 generates signals S1N and S2N that command the multiplexer MUX2 to switch between the odd-numbered dot data and the even-numbered dot data.

The even-odd switching signals S1N and S2N are also connected to the input terminals of a pair of buffers 123 and 124. The outputs of the buffers 123, 124 are connected to the gate driving terminals G1, G2 of the driver IC, and are thereby connected to the gates of the light-emitting thyristors in the light-emitting thyristor array, as shown in FIG. 3. Each of these buffers 123, 124 operates as a common buffer that switches the potentials at the third terminals of a plurality of the three-terminal light-emitting thyristors simultaneously.

The driver IC also includes a control voltage generator or ADJ block 122, which receives the reference voltage VREF input from the VREF terminal and generates a control voltage supplied to the DRV blocks 119 for use in driving the light-emitting thyristors.

Flip-flops FFA1 to FFA25 are cascaded, the data output terminal Q of each flip-flop being connected to the data input terminal D of the next flip-flop in the cascade. The data input terminal D of flip-flop FFA1 is connected to the data input terminal DATAI0 of the driver IC, the data output terminals Q of flip-flops FFA24 and FFA25 are connected to the selector circuit input terminals A0 and B0, respectively, and the corresponding output terminal Y0 of the selector circuit 120 is connected to data output terminal DATAO0 of the driver IC.

Flip-flops FFB1 to FFB25, FFC1 to FFC25, and FFD1 to FFD25 are connected in like manner. The data input terminals D of flip-flops FFB1, FFC1, and FFD1 are respectively connected to the data input terminals DATAI1, DATAI2, and DATAI3 of the driver IC. The outputs from flip-flops FFB24 and FFB25, FFC24 and FFC25, and FFD24 and FFD25 are connected to the selector circuit SEL. The corresponding outputs Y1, Y2, and Y3 of the selector circuit are respectively connected to data output terminals DATAO1, DATAO2, and DATAO3 of the driver IC. Therefore, the flip-flops FFA1 to FFA25, FFB1 to FFB25, FFC1 to FFC25, and FFD1 to FFD25 form respective twenty-five-stage shift register circuits, but the number of stages can be switched between twenty-four and twenty-five by the selector circuit 120.

Data output terminals DATAO0 to DATAO3 of the driver IC are connected to the data input terminals DATAI0 to DATAI3 of the next-stage driver IC (not shown). All the shift registers of the driver ICs IC1 to IC26 together form a (24×26)-stage or (25×26)-stage four-bit-wide shift register for storing the data signals HD-DATA3 to HD-DATA0 input from the printing control unit 1 to the first driver IC DRV1 in synchronization with the clock signal HD-CLK.

The latch circuits LTA1 to LTA24, LTB1 to LTB24, LTC1 to LTC24, and LTD1 to LTD24 latch the outputs of the first twenty-four stages of the shift register in accordance with a latch signal LOAD-P. Latch circuits LTA1 to LTA24 latch the HD-DATA0 bits stored in flip-flops FFA1 to FFA24. Latch circuits LTB1 to LTB24 latch the HD-DATA1 bits stored in flip-flops FFB1 to FFB24. Latch circuits LTC1 to LTC24 latch the HD-DATA2 bits stored in the flip-flops FFC1 to FFC24. Latch circuits LTD1 to LTD24 latch the HD-DATA3 bits stored in flip-flops FFD1 to FFD24. The strobe signal HD-STB-N input to the strobe terminal STB and the latch signal LOAD-P input to the terminal LOAD are input through the inverters 112 and 113 to the NAND circuit 114, where a signal for strobing the even and odd dots is generated and output to the light-emitting thyristor driving blocks DRV.

Figure 9:
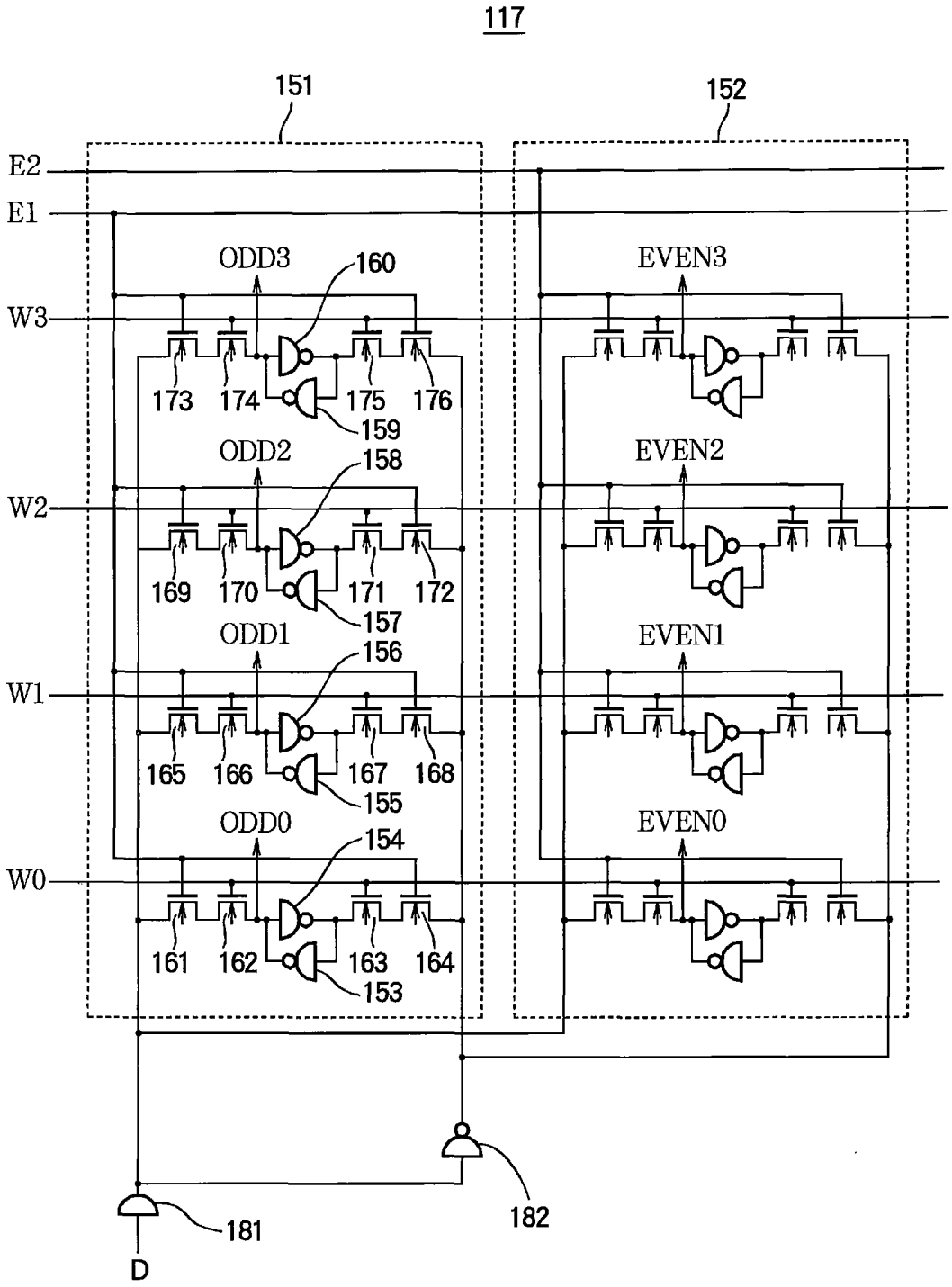
FIG. 9 is a circuit diagram showing the structure of the memory circuits in FIG. 8.

FIG. 9 is a circuit diagram showing the structure of each of the MEM2 memory circuit blocks 117 in FIG. 8. This embodiment uses four-bit dot compensation data to compensate for variations in light output among the light-emitting thyristors by making a sixteen-level adjustment of the driving current supplied to each light-emitting thyristor. FIG. 9 shows a pair of adjacent memory cell circuits 151, 152 for two dots. The left-side circuit 151 stores compensation data of an odd-numbered dot (such as light-emitting thyristor 101), and the right-side circuit 152 stores compensation data of an even-numbered dot (such as light-emitting thyristor 102). The memory circuit MEM2 includes a buffer circuit 181, an inverter 182 provided to generate a complementary data signal, inverters 153 to 160 forming compensation data memory cells, and N-channel metal-oxide-semiconductor (NMOS) transistors 161 to 176.

The MEM2 block 117 has a compensation data input terminal D, an enable signal terminal E1 for enabling the writing of data for odd-numbered dots, an enable signal terminal E2 for enabling the writing of data for even-numbered dots, memory cell selection terminals W0 to W3, compensation data output terminals ODD0 to ODD3 for odd-numbered dots, and compensation data output terminals EVN0 to EVN3 for even-numbered dots.

The data input terminal D of the MEM2 block 117 is connected to the data output terminal Q of one of the flip-flops FFA1 to FFA24, FFB1 to FFB24, FFC1 to FFC24, and FFD1 to FFD24. Write command signals W0 to W3 are input from control circuit CTRL1 115 to the memory cell selection terminals W0 to W3. Write enable signals E1 to E2 are input from control circuit CTRL1 115.

The compensation data input terminal D is the input terminal of the buffer circuit 181. The output terminal of the buffer circuit 181 is connected to the first main terminals of NMOS transistors 161, 165, 169, and 173. The input terminal of the inverter 182 is connected to the output terminal of the buffer circuit 181, and the output terminal of the inverter 182 is connected to the first main terminals of NMOS transistors 164, 168, 172, and 176. Pairs of inverters 153-154, 155-156, 157-158, and 159-160 are cross-coupled to form respective memory cells. Pairs of NMOS transistors 161-162, 163-164, 165-166, 167-168, 169-170, 171-172, 173-174, and 175-176 are connected to these memory cells to form four series circuits, each having a memory cell connected between two pairs of transistors. One end of the series circuit is connected to the output of buffer circuit 181, and the other end is connected to the output of inverter 182.

The gates of NMOS transistors 162 and 163 are connected to selection terminal W0. The gates of NMOS transistors 166 and 167 are connected to selection terminal W1. The gates of NMOS transistors 170 and 171 are connected to selection terminal W2. The gates of NMOS transistors 174 and 175 are connected to selection terminal W3. Enable signal terminal E1 is connected to the gates of NMOS transistors 161, 164, 165, 168, 169, 172, 173, and 176.

The output of inverter 153 is connected to data output terminal ODD0. The output of inverter 155 is connected to data output terminal ODD1. The output of inverter 157 is connected to data output terminal ODD2. The output of inverter 159 is connected to data output terminal ODD3. Those connections are made in the b151. Similar connections are made in memory cell 152, except that the enable signal is E2 and the output signals are EVN0 to EVN3.

Figure 10:
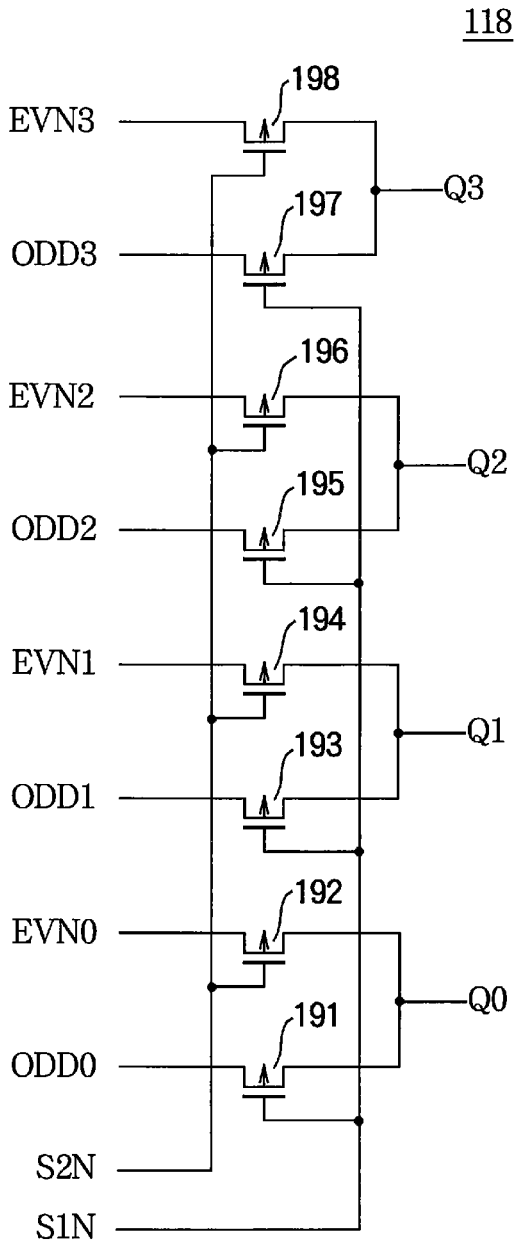
FIG. 10 is a circuit diagram showing the structure of the multiplexer circuits in FIG. 8.

FIG. 10 shows the structure of the MUX2 multiplexer circuit blocks 118 in FIG. 8. FIG. 10 shows one MUX2 block, comprising four one-bit multiplexer circuits formed by P-channel metal-oxide-semiconductor transistors (PMOS) transistors 191-198. The gates of PMOS transistors 191, 193, 195, and 197 are connected to the S1N input terminal; the gates of PMOS transistors 192, 194, 196, and 198 are connected to the S2N input terminal.

The first main terminal of PMOS transistor 191 is connected to the ODD0 input terminal of the multiplexer; the first main terminal of PMOS transistor 192 is connected to the EVN0 input terminal; the second main terminals of PMOS transistors 191 and 192 are connected to the Q0 output terminal. Similarly, the first main terminal of PMOS transistor 193 is connected to the ODD1 input terminal; the first main terminal of PMOS transistor 194 is connected to the EVN1 input terminal; the second main terminals of PMOS transistors 193 and 194 are connected to the Q1 output terminal. The first main terminal of PMOS transistor 195 is connected to the ODD2 input terminal; the first main terminal of PMOS transistor 196 is connected to the EVN2 input terminal; the second main terminals of PMOS transistors 195 and 196 are connected to the Q2 output terminal. The first main terminal of PMOS transistor 197 is connected to the ODD3 input terminal; the first main terminal of PMOS transistor 198 is connected to the EVN3 input terminal; the second main terminals of PMOS transistors 197 and 198 are connected to the Q3 output terminal.

The use only of PMOS transistors as switching elements in the multiplexer circuits is an unconventional structure adopted for the following reason. When the S1N signal is brought low to turn on PMOS transistor 191, for example, if the ODD0 signal is at the high logic level (the power supply level), a voltage substantially equal to the ODD0 signal level is output from terminal Q0. If the ODD0 signal is at the low logic level (0 V, the ground level), however, PMOS transistor 191 can pull the voltage at output terminal Q0 down only as far as a level close to the source-gate threshold voltage Vt of PMOS transistor 191 before PMOS transistor 191 turns off.

Transmission of low voltage levels in general is a problem for PMOS switching elements, as is the transmission of high voltage levels for NMOS switching elements. In conventional multiplexers, this problem is solved by use of analog switches formed by connecting PMOS and NMOS transistors in parallel. An analog switch can transmit a signal with any voltage level from the power supply level down to the ground level, substantially without change. Since analog switches require a PMOS-NMOS transistor pair for each transmitted signal, however, they include twice as many transistors as the structure shown in FIG. 10 and take up an inconveniently large amount of space in conventional driver chips.

The multiplexer structure in FIG. 10 thus saves space. Although this structure cannot transmit voltages close to 0 V, the driving circuit to which the multiplexer outputs are connected can operate with high and low input levels respectively equal to the power supply voltage (VDD) and the control voltage output from the control voltage generator 122. This control voltage is higher than the PMOS threshold voltage Vt. The simplified in FIG. 10 can therefore reduce the number of multiplexer circuit elements without imposing unnecessary constraints on circuit operation.

Figure 11:
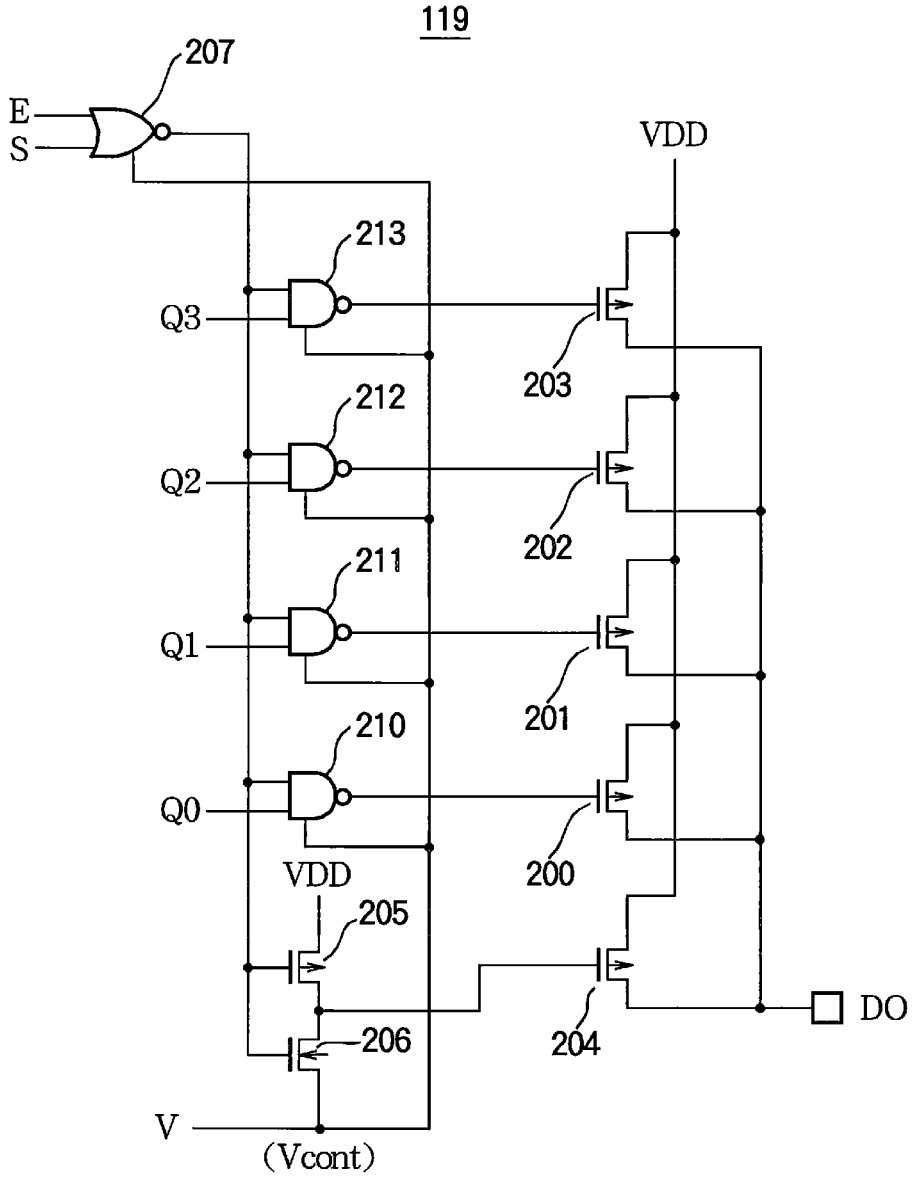
FIG. 11 is a circuit diagram showing the structure of the light-emitting element driving circuits in FIG. 8.

FIG. 11 shows the light-emitting thyristor driving circuit structure of each of the DRV blocks 119 in FIG. 8. The driving circuit includes PMOS transistors 200 to 205, an NMOS transistor 206, a NOR circuit 207, and NAND circuits 210 to 213. PMOS transistor 205 and NMOS transistor 206 form an inverter. The driving circuit also includes a print data input terminal E, a strobe input terminal S, an input terminal V, compensation data input terminals Q0 to Q3, and a driving current output terminal DO, which is one of the driving current output terminals DO1 to DO96 in FIG. 8.

The print data input terminal E of the DRV block is connected to the QN output terminal of one of the latch circuits LTAi to LTDi (i=1 to 24) in FIG. 8. The Q3 to Q0 input terminals are connected to the compensation data output terminals Q3 to Q0 of the multiplexer circuit in FIG. 10. The strobe input terminal S receives a signal, output from the NAND circuit 114 in FIG. 8, for enabling and disabling the driving of the light-emitting thyristors. The V input terminal receives the control voltage Vcont output from the control voltage generator 122 in FIG. 8. The driving current output terminal DO is connected to the anodes of a pair of light-emitting thyristors by bonding wires or the thin-film wiring mentioned above (not shown). The two input terminals of the NOR circuit 207 are connected to the E and S input terminals. The first input terminals of the NAND circuits 210 to 213 are connected to the output terminal of the NOR circuit 207. The second input terminals of the NAND circuits 210 to 213 are connected to respective compensation data input terminals Q0 to Q3.

The gate terminals of PMOS transistors 200 to 203 are connected to the output terminals of respective NAND circuits 210 to 213. The source terminals of PMOS transistors 200 to 205 are connected to the power supply VDD. The drain terminals of PMOS transistors 200 to 204 are connected to the driving current output terminal DO. The power supply terminals (not shown) of the NAND circuits 210 to 213 and the NOR circuit 207 are connected to the power supply VDD, and the ground terminals of these circuits, together with the source terminal of NMOS transistor 206, are connected to terminal V and held at the control voltage Vcont.

The difference between the power supply voltage VDD and the control voltage Vcont is slightly greater than the gate-source voltage Vt at which PMOS transistors 200 to 204 turn on, so that PMOS transistors 200 to 204 operate as current sources that supply differing amounts of current, which can be adjusted by adjusting the control voltage Vcont. The control voltage Vcont is adjusted by the chip compensation data output from the MEM1 block 121 in FIG. 8.

In FIG. 11, when the print data and strobe inputs are both in the active state (the input levels at the E and S terminals are both low), the output of the NOR circuit 207 is high, so the output level of the inverter formed by PMOS transistor 205 and NMOS transistor 206 is the control voltage Vcont, and PMOS transistor 204, which is the main driving transistor, is turned on. PMOS transistor 204 supplies main driving current to the driven light-emitting thyristor. The output signal levels of the NAND circuits 210 to 213 are VDD or Vcont, depending on the compensation data received at the Q3 to Q0 input terminals. PMOS transistors 200 to 203, which are auxiliary driving transistors, are switched on or off accordingly to supply additional driving current to adjust the amount of light emitted by the driven light-emitting thyristor.

PMOS transistor 204 is therefore driven in accordance with the print data, and when PMOS transistor 204 is turned on (when the output of the NOR circuit 207 is high), PMOS transistors 200 to 203 are selectively driven in accordance with the dot compensation data. The driving current supplied from terminal DO to the light-emitting thyristor is the sum of the drain current of PMOS transistor 204 and the drain currents of the selected auxiliary driving transistors 200 to 203. PMOS transistors 200 to 204 combine to operate as an adjustable and switchable current source that can be switched on to provide an adjustable amount of current.

PMOS transistors 200 to 203 are turned on when the outputs of the NAND circuits 210 to 213 are low, but their low output level is substantially equal to the control voltage Vcont, so the gate voltage of PMOS transistors 200 to 203 is substantially equal to Vcont. Similarly, PMOS transistor 204 is turned on when PMOS transistor 205 is in the off state and NMOS transistor 206 is in the on state, so the gate voltage of PMOS transistor 204 is substantially equal to Vcont. Therefore, PMOS transistors 200 to 204 are all switched on and off by logic circuits powered by the power supply voltage VDD and control voltage Vcont, and the drain currents of PMOS transistors 200 to 204 can all be adjusted by adjusting the control voltage Vcont.

Since the NAND circuits 210 to 213 use VDD and Vcont as their high and low power supply voltages, the high and low logic levels of their input signals may likewise be VDD and Vcont, or VDD and a voltage level between Vcont and 0 V; the low input logic level does not have to be 0 V.

The range of voltages over which the control voltage Vcont may be adjusted must lie between the PMOS transistor source-gate threshold voltage Vt and a value (VDD−Vt) less than the power supply voltage VDD by this amount Vt. In practice, the control voltage Vcont is adjusted in a range that is close to the latter value (VDD−Vt) and well above Vt.

Figure 12:
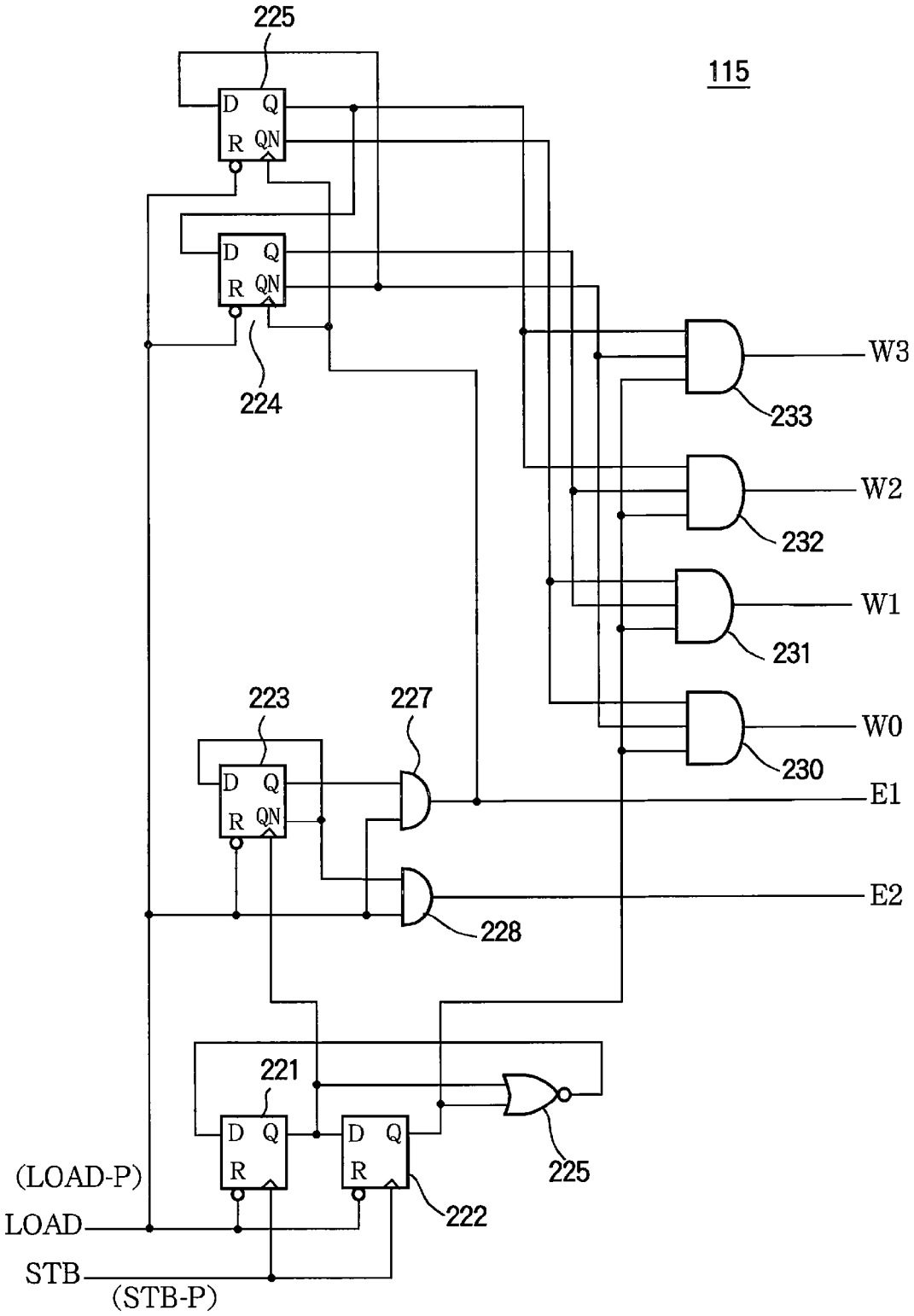
FIGS. 12 and 13 are circuit diagrams showing the structure of the control circuits in FIG. 8.

FIG. 12 is a circuit diagram showing the structure of the CTR1 control circuit block 115 in FIG. 8. This circuit includes flip-flops 221 to 225, a NOR circuit 226; AND circuits 227 and 228, and further AND circuits 230 to 233. In the flip-flops 221 to 225, the negative-logic reset terminal R is connected to the LOAD terminal to receive the latch signal LOAD-P. The clock terminals of flip-flops 221 and 222 are connected to the strobe (STB) terminal to receive the STB-P signal. The Q outputs of flip-flops 221 and 222 form the two inputs of the NOR circuit 226; the output of the NOR circuit 226 is connected to the D input of flip-flop 221.

The clock terminal of flip-flop 223 is connected to the Q output terminal of flip-flop 221, and the QN output terminal of flip-flop 223 is connected to the D input terminal of flip-flop 223 itself. The Q output terminal of flip-flop 223 is connected to one input terminal of AND circuit 227; the QN output terminal of flip-flop 223 is connected to one input terminal of AND circuit 228; The LOAD-P signal is input to the other input terminals of the AND circuits 227 and 228. The outputs of the AND circuits 227 and 228 are connected to terminals E1 and E2 as write enable signals for the MEM2 memory blocks 117 in FIG. 8.

The clock terminals of flip-flops 224 and 225 are connected to the output of AND circuit 227; the D input terminal of flip-flop 224 is connected to the Q output terminal of flip-flop 225; the D input terminal of flip-flop 225 is connected to the QN output terminal of flip-flop 224. The first input of AND circuit 233 is connected to the Q output terminal of flip-flop 225; the second input of AND circuit 233 is connected to the QN output terminal of flip-flop 224; the first input terminal of AND circuit 232 is connected to the Q output terminal of flip-flop 225; the second input terminal of AND circuit 232 is connected to the Q output terminal of flip-flop 224; the first input terminal of AND circuit 231 is connected to the QN output terminal of flip-flop 225; the second input terminal of AND circuit 231 is connected to the Q output terminal of flip-flop 224; the first input terminal of AND circuit 230 is connected to the QN output terminal of flip-flop 225; the second input terminal of AND circuit 230 is connected to the QN output terminal of flip-flop 224; and the third inputs of AND circuits 230 to 233 are connected to the Q output terminal of flip-flop 222. The output terminals of the AND circuits 230 to 233 are connected to the W0 to W3 terminals to provide write command signals for the MEM2 memory blocks shown in FIG. 8.

Figure 13:
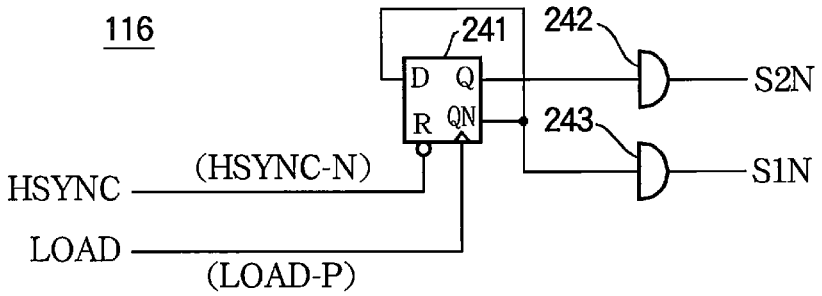

FIG. 13 is a circuit diagram showing the structure of the CTRL2 control circuit block 116 in FIG. 8. This circuit includes a flip-flop 241 and buffer circuits 242 and 243. The flip-flop 241 has its clock terminal connected to the LOAD terminal to receive the LOAD-P signal, its negative-logic reset terminal R connected to the HSYNC terminal to receive an HSYNC-N signal, and its D input terminal connected to its own QN output terminal. The input terminal of buffer circuit 242 is connected to the Q output terminal of the flip-flop 241, and the input terminal of buffer circuit 243 is connected to the QN output terminal of the flip-flop 241. The output terminals of buffer circuits 243 and 242 are connected to the S1N and S2N terminals, respectively, to control the multiplexer circuits 117 and common gate driving buffers 123, 124 in FIG. 8.

The CTRL2 control circuit block 116 and these buffers 123, 124 form a switching circuit for switchably connecting the gate terminals of the light-emitting thyristors to the power supply VDD and ground.

Figure 14:
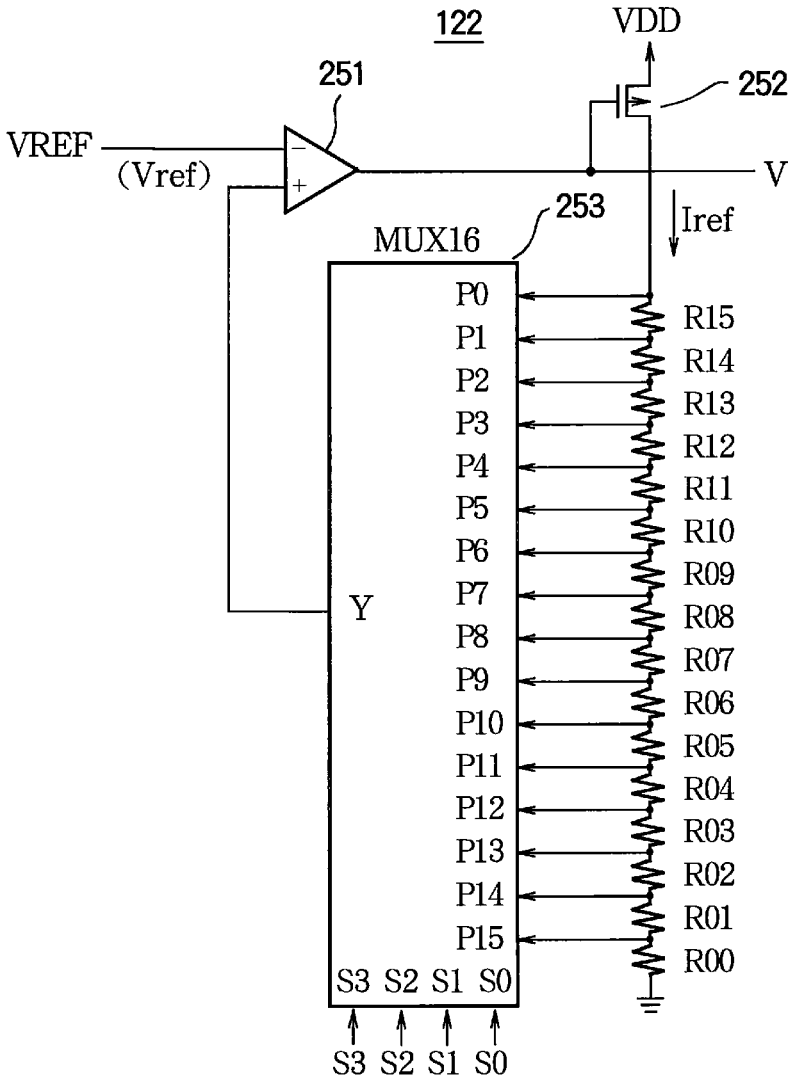
FIG. 14 is a circuit diagram of a control voltage generator in the adjustment block in FIG. 8.

FIG. 14 shows the internal structure of the control voltage generator or ADJ block 122 in FIG. 8. One such control voltage generator is provided for each driver IC. The circuit in FIG. 14 includes an operational amplifier 251, a PMOS transistor 252, an analog multiplexer circuit 253, and a resistor ladder with sixteen resistors R00 to R15 connected in series. The PMOS transistor 252 has its source connected to the power supply VDD, and its gate connected to the output terminal of the operational amplifier 251 and to the control voltage output terminal V. This PMOS transistor 252 has the same gate length as PMOS transistors 200 to 204 in FIG. 11. The drain current of PMOS transistor 252 is denoted Iref.

The operational amplifier 251 has its inverting input terminal connected to the VREF terminal to receive the reference voltage Vref, and its non-inverting input terminal connected to the output terminal Y of the analog multiplexer circuit 253. The output terminal of the operational amplifier 251 is connected to the gate terminal of PMOS transistor 252 and to the control voltage output terminal V, which is connected to the V terminals of the DRV block circuits 119 in FIG. 11.

The analog multiplexer circuit 253 has sixteen input terminals P0 to P15 for analog voltage input from the resistor ladder, an output terminal Y for analog voltage output, and four input terminals S3 to S0 for logic signal input. The sixteen combinations of logic states of the four logic signal inputs are decoded to select one of the input terminals P0 to P15, and the voltage at the selected input terminal is output from the output terminal Y. In other words, the logic signals received at the input terminals S3 to S0 select a current path from a node in the resistor ladder to the output terminal Y.

The operational amplifier 251, resistor ladder, and PMOS transistor 252 form a feedback control circuit that keeps the voltage at the non-inverting input terminal of the operational amplifier 251 substantially equal to the reference voltage Vref. The drain current Iref of PMOS transistor 252 in FIG. 14 is therefore determined by the reference voltage Vref input to the operational amplifier 251 and the combined resistance of the resistors from R00 to the node selected by the analog multiplexer circuit 253.

For example, if the logic values at the input terminals S3 to S0 are '1111', specifying maximum compensation, terminal P15 is selected and its voltage is brought substantially to the reference voltage Vref. As a result, the drain current Iref of PMOS transistor 252 can be calculated as follows.

$$Iref=Vref/R00$$

If the logic values at the input terminals S3 to S0 are '0111', specifying a medium compensation level, terminal P7 is selected, its voltage is brought substantially to Vref, and the drain current Iref of PMOS transistor 252 can be calculated as follows.

$$Iref=Vref/(R00+R01+\ldots+R07+R08)$$

If the logic values at the input terminals S3 to S0 are '0000', specifying minimum compensation, terminal P0 is selected, its voltage is brought substantially to Vref, and the drain current Iref of PMOS transistor 252 can be calculated as follows.

$$Iref=Vref/(R00+R01+\ldots+R14+R15)$$

PMOS transistors 200 to 204 in FIG. 11 and PMOS transistor 252 in FIG. 14 have the same gate length and operate in their saturation region. Accordingly, these transistors are in a current mirror relationship such that when PMOS transistors 200 to 204 are turned on, a drain current proportional to Iref is generated. The current Iref can be adjusted to one of sixteen levels specified by the logic states of input terminals S3 to S0. The drain currents of PMOS transistors 200 to 204 in FIG. 11 can therefore also be adjusted to one of sixteen levels.

Figure 15:
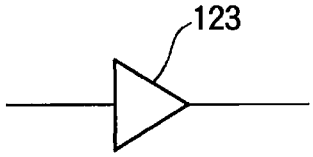
FIGS. 15 and 16 are circuit diagrams of the light-emitting thyristor gate driving buffer circuits in FIG. 8.
Figure 16:
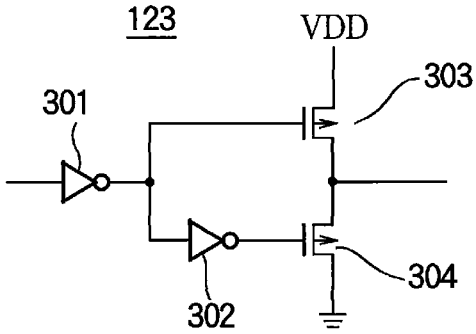

FIG. 15 shows the circuit symbol of the common gate driving buffer 123 in FIG. 8. FIG. 16 shows the circuit structure of each of the common gate driving buffers 123 and 124 in FIG. 8. The circuit in FIG. 16 includes a pair of inverters 301 and 302 and a pair of PMOS transistors 303 and 304. The input terminal of inverter 301 is the input terminal of the buffer circuit. The output terminal of inverter 301 is connected to the input terminal of inverter 302 and the gate of PMOS transistor 303. The output terminal of inverter 302 is connected to the gate of PMOS transistor 304. PMOS transistor 303 has its source connected to the power supply VDD and its drain connected to the source of PMOS transistor 304 and the output terminal of the buffer circuit. The drain of PMOS transistor 304 is grounded.

The common gate-driving buffers 123 and 124 are thus configured as push-pull buffers, each having a pair of semiconductor switching elements (PMOS transistors 303 and 304) of identical semiconductor conductive type (P-channel type) connected in series between the power supply VDD and ground. When the signal input to the buffer (the input signal to inverter 301) is high, PMOS transistor 303 switches on and pulls the output terminal (terminal G1 or G2) up to the VDD level. When the input signal is low, PMOS transistor 304 turns on and pulls the output terminal down to a level about Vt higher than the ground level, where Vt is the PMOS transistor threshold voltage. If the potential at the output terminal goes lower than this level, PMOS transistor 304 turns off, because its source-gate voltage is less than its threshold voltage. PMOS transistor 304 accordingly operates as a self-opening switching element that switches off when the potential at the output terminal differs from ground by less than Vt.

Figure 17:
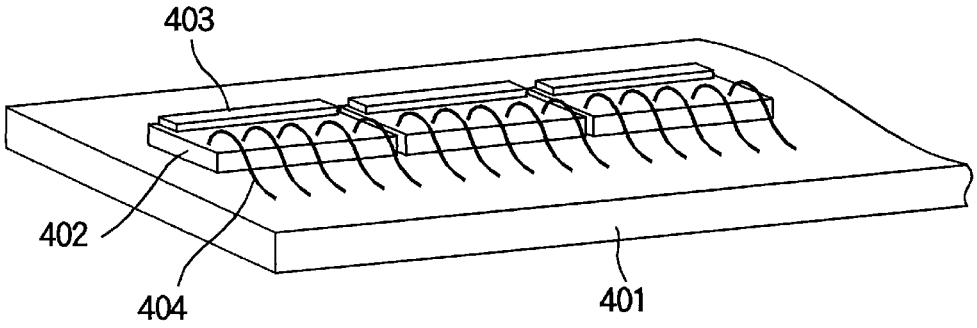
FIG. 17 is a schematic perspective view of the circuit board in the electrophotographic print head.

FIG. 17 is a perspective view of the optoelectronic unit in an electrophotographic print head in which composite light-emitting and driver chips are mounted on a printed wiring board. The optoelectronic unit includes a printed wiring board 401, IC chips 402 (IC1 to IC26 in the present embodiment), and light-emitting thyristor arrays 403 (CHP1 to CHP26 in the present embodiment) bonded onto the IC chips 402. The wiring pattern (not shown) on the printed wiring board 401 is connected by bonding wires 404 to terminals (not shown) on the driver ICs 402.

Figure 18:
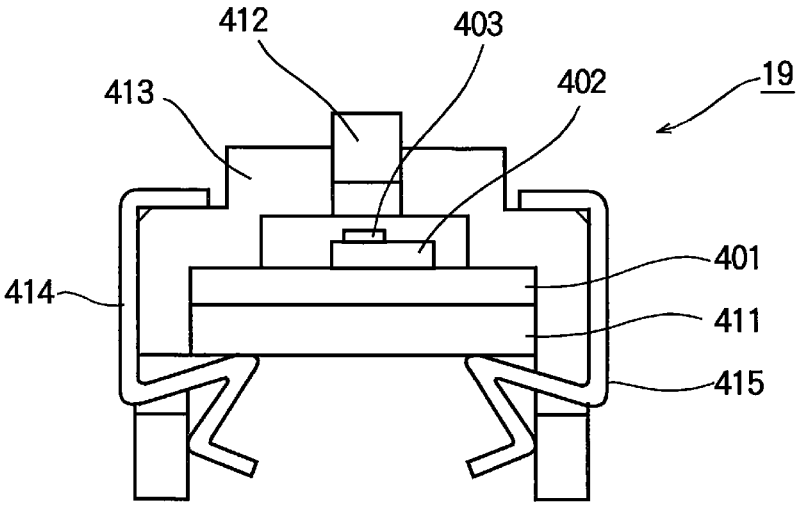
FIG. 18 is a schematic sectional view showing the structure of the electrophotographic print head.

FIG. 18 is a schematic sectional view showing the structure of the electrophotographic print head 19. The printed wiring board 401 with its IC chips 402 and light-emitting thyristor arrays 403 is mounted on a base 411. A rod lens array 412 including an array of cylindrical optical elements is held above the light-emitting thyristor arrays 403 in a holder 413. The base 411 and holder 413 are held together by a pair of clamping members 414 and 415. The rod lens array 412 is positioned facing the light-emitting thyristor arrays 403.

The operation of the first embodiment will now be described with reference to the timing waveform diagrams in FIGS. 19 to 24 and the circuit diagrams in FIGS. 25 to 29.

Figure 3:
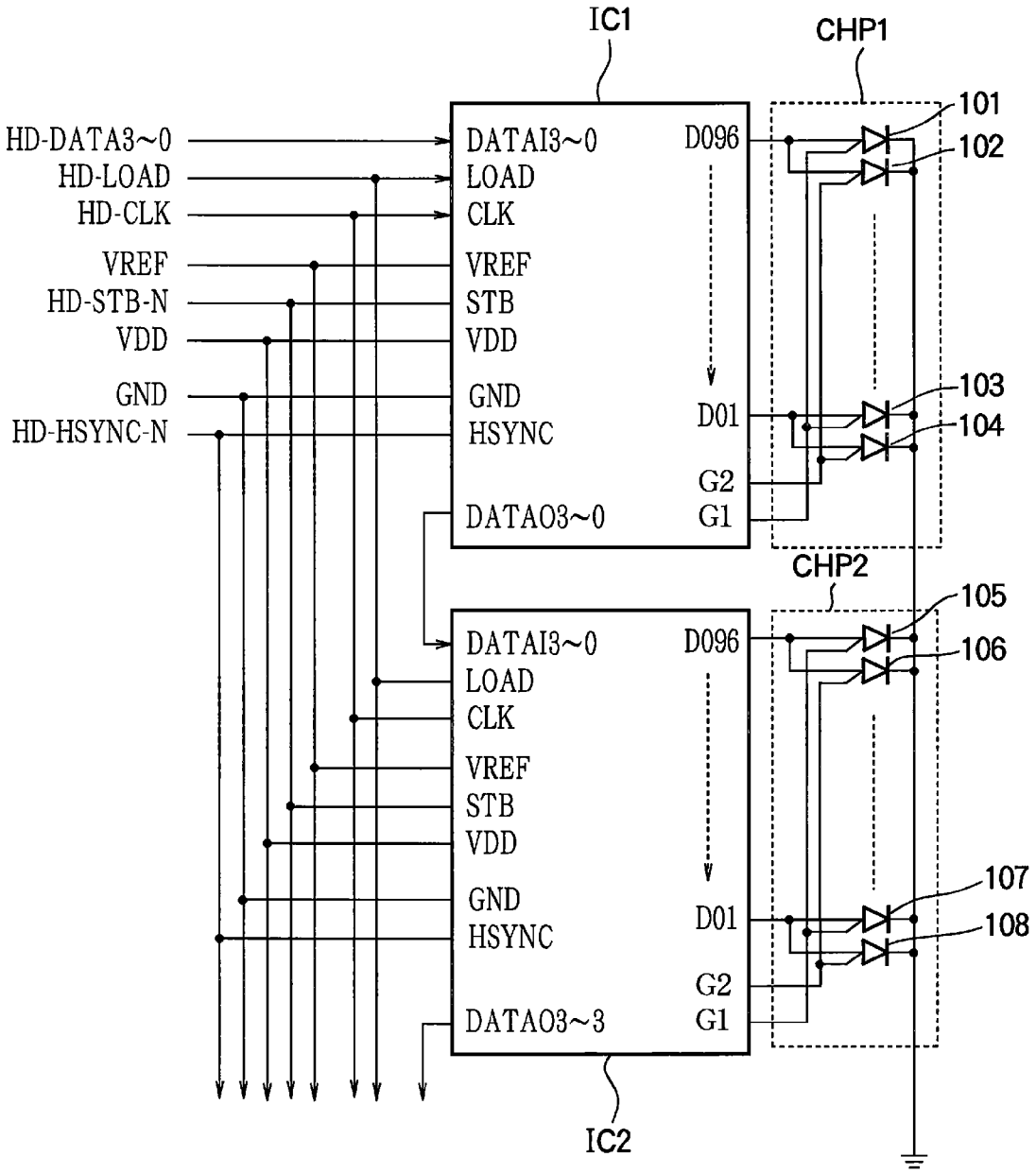
FIG. 3 is a circuit diagram showing the structure of the optical print head in a first embodiment.
Figure 19:
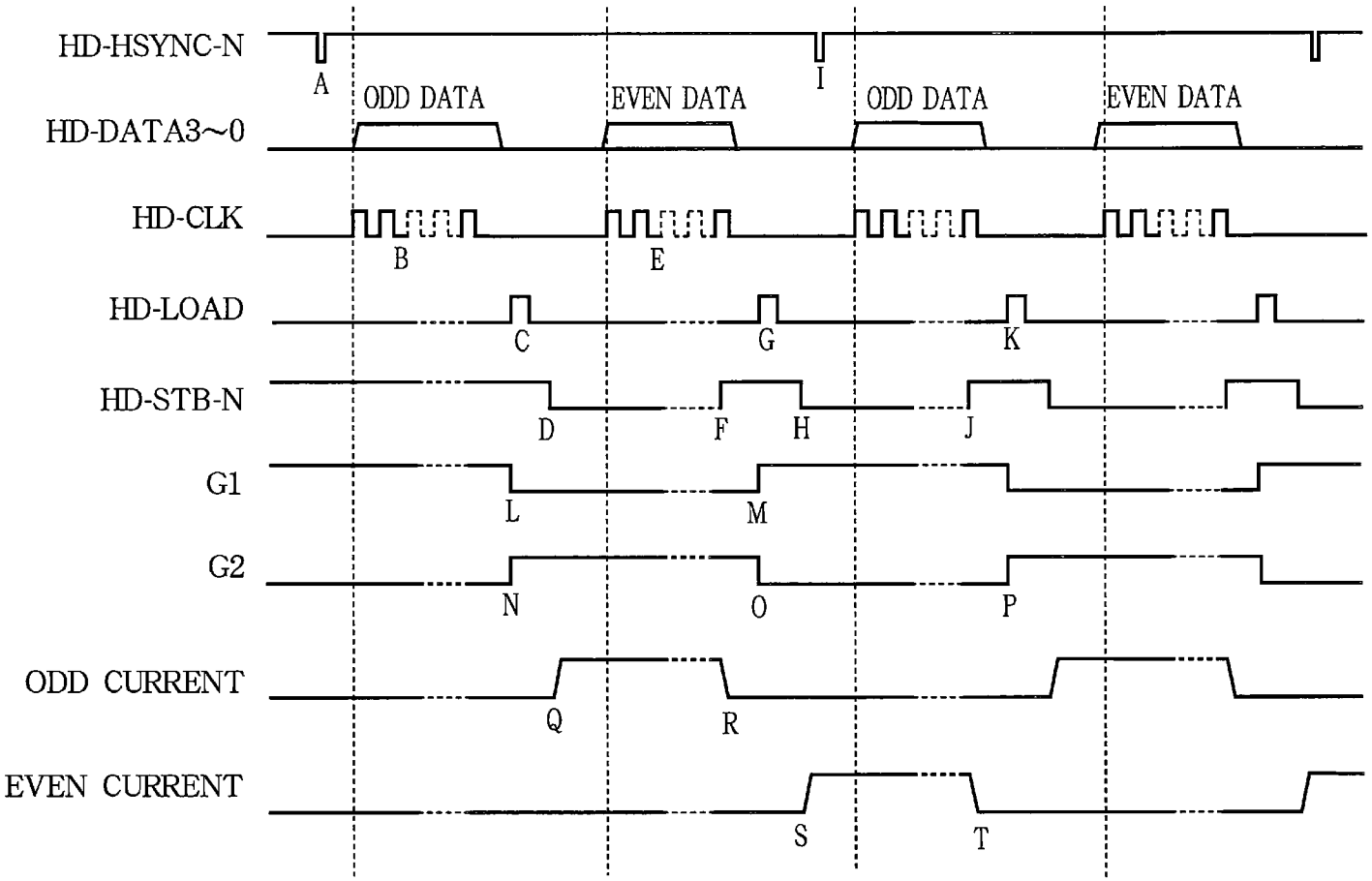
FIG. 19 is a timing waveform diagram illustrating the printing operation of the electrophotographic print head.

FIG. 19 illustrates the printing operation of the electrophotographic print head in FIG. 3. The operations that print the first dot line are initiated by input of a synchronizing signal (D-HSYNC-N) pulse A. This pulse A is followed by a series of clock signal (HD-CLK) pulses B, in synchronization with which print data (odd data) for driving the odd-numbered light-emitting thyristors are input by data signals HD-DATA3 to HD-DATA0. Since the electrophotographic print head has twenty-six driver ICs connected in cascade, each IC has ninety-six current driving terminals, and the print data for four dots are transferred simultaneously on each pulse of the clock signal, the number of clock pulses required to transfer all the odd-dot data for a single dot line is:

$$(96/4)\times 26=24\times 26=624$$

These clock pulses B move data for the odd-numbered dots into the shift register formed by flip-flops FFA1, FFB1, etc. (FIG. 8) in the driver ICs. A latch signal (HD-LOAD) pulse C then causes the latch circuit (LTA1, LTB1, etc.) in each driver IC to latch the data held in the flip-flops. The thyristor gate driving signals G1 and G2 go low and high, respectively, at this time, as indicated by the falling edge L and rising edge N of their waveforms. Then the strobe signal HD-STB-N for driving the light-emitting thyristors goes low (falling edge D), and the driver ICs (IC1 to IC26) output driving current at their driving output terminals DO1 to DO96 in accordance with the print data during the interval from Q to R in the odd current waveform. This waveform is the waveform of the driving current output for the odd dots that are turned on by the printed data; no current is output for dots that are turned off by the print data.

The light-emitting thyristors that can be driven in the Q-R interval are the light-emitting thyristors with gates connected to the G1 terminals of the driver ICs, such as light-emitting thyristors 101, 103, 105, 107 in FIG. 3. If driving current is output from the DO1 terminal of driver IC IC1, for example, light-emitting thyristor 104 turns on because its gate is low and a current path is formed from the DO1 terminal through the anode and cathode of light-emitting thyristor 103 to ground. Light-emitting thyristor 104 remains turned off and does not conduct current, because its gate is at the high logic level (VDD). As a result, light-emitting thyristor 103 illuminates the charged photosensitive drum (not shown) to form a latent dot, while light-emitting thyristor 104 remains unlit. When the negative-logic strobe signal HD-STB-N goes high (F), all output of driving current from the driver ICs halts (R), turning off all the light-emitting thyristors.

A similar sequence is used to form the even-numbered dots. Their driving data (even data) is transferred into the shift register by the data signals HD-DATA3 to HD-DATA0 in synchronization with clock HD-CLK pulses E, followed by a latch (HD-LOAD) pulse G that loads the data into the latch circuit. Simultaneously with the latch pulse, gate driving signal G1 goes high (M) and gate driving signal G2 goes low (O).

Next, the strobe signal HD-STB-N goes low again (H), causing the driver ICs (IC1 to IC26) to output driving current from their DO1 to DO96 terminals in accordance with the dot data during the S-T interval, as indicated by the even current waveform in FIG. 19. The light-emitting thyristors that can be driven are now the light-emitting thyristors with gates connected to the G2 terminal, such as light-emitting thyristors 102, 104, 106, 108 in FIG. 3. If driving current is output from the DO1 terminal of driver IC IC1, for example, light-emitting thyristor 104 turns on because its gate is low, and a current path is formed from the DO1 terminal through the anode and cathode of light-emitting thyristor 104 to ground. Light-emitting thyristor 103 remains turned off and does not conduct current, because its gate is high.

As a result, light-emitting thyristor 104 illuminates the charged photosensitive drum (not shown) to form a latent dot, while light-emitting thyristor 103 remains unlit. When the strobe signal HD-STB-N goes high (J), all output of driving from the driver ICs halts (T), turning off all the light-emitting thyristors.

While the even-numbered light-emitting thyristors are being driven, the next synchronization (HD-SYNC-N) pulse I is input and the loading of the shift register with the data for the odd-numbered dots in the next line begins. The above sequence then continues, the odd-numbered light-emitting thyristors and the even-numbered light-emitting thyristors being driven alternately in each line.

Figure 20:
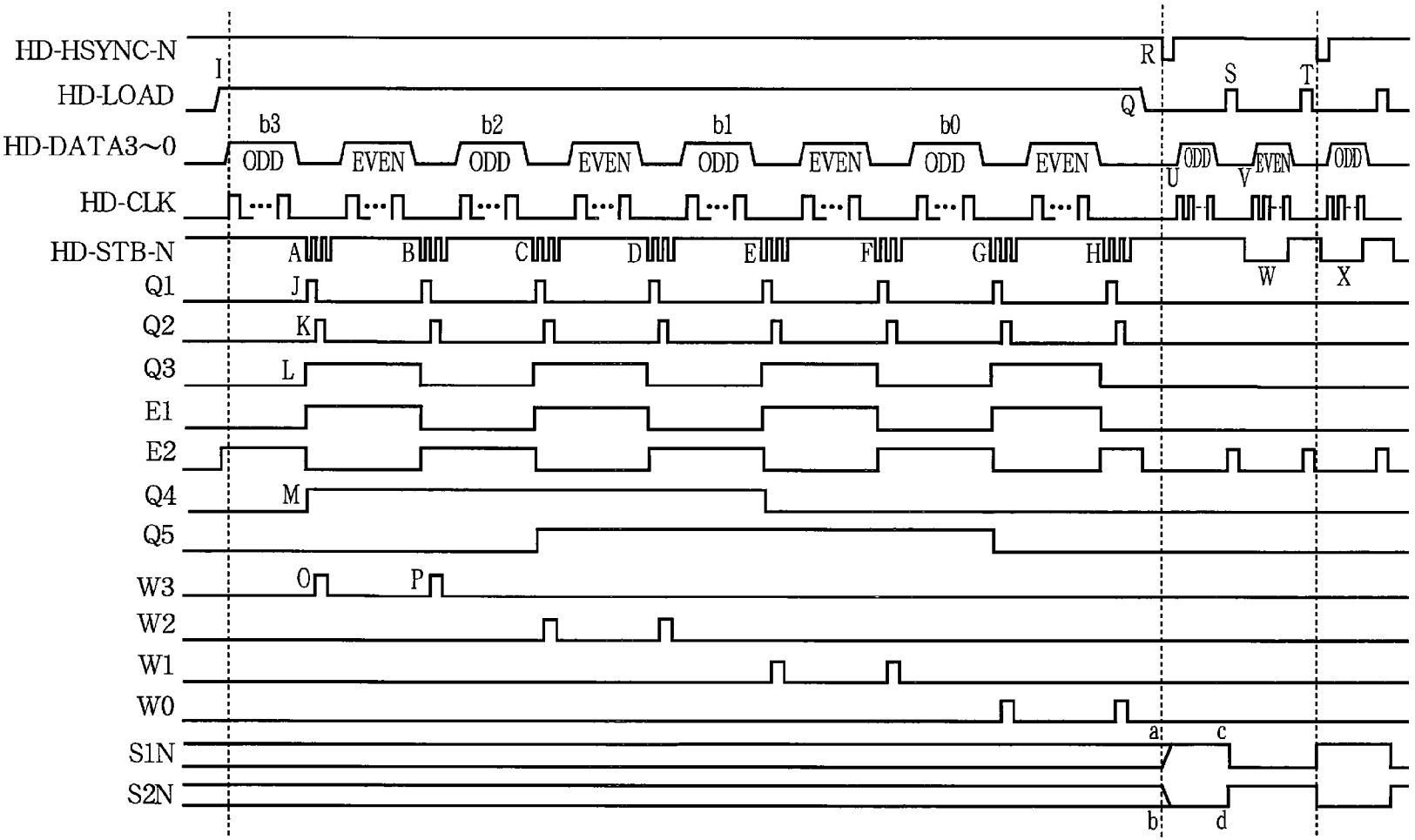
FIG. 20 is a timing waveform diagram illustrating the compensation data transfer process and the start of the printing operation.

FIG. 20 illustrates the compensation data transfer process and printing data transfer process performed by the electrophotographic print head in the first embodiment when the printer is powered up. Prior to the compensation data transfer process, the HD-LOAD signal is brought high (I) to indicate that compensation data will be transferred. Next, the most significant bit b3 (bit 3) of the four-bit compensation data for the odd-numbered dots is input to the shift register formed by the flip-flops (FFA1, FFB1, etc. in FIG. 8) in the driver ICs from signal lines HD-DATA3 to HD-DATA0, in synchronization with the clock signal HD-CLK. When the shift input ends, three strobe (HD-STB-N) pulses A are input, activating the CTRL1 control circuit shown in FIG. 12.

Q1 and Q2 in FIG. 20 are the Q outputs of flip-flops 221 and 222 in FIG. 12; Q3 is the Q output of flip-flop 223; Q4 is the Q output of flip-flop 225; and Q5 is the Q output signal of flip-flop 224. E1 and E2 are the outputs of AND circuits 227, 228, and W3 to W0 are the output signals of AND circuits 233 to 230. The S1N and S2N signals are output from the buffer circuits 243 and 242 in FIG. 13.

When the first pulse of the HD-STB-N signal is input at A in FIG. 20, the Q1 signal goes high for one strobe cycle, as shown at J. The second pulse of the HD-STB-N signal causes the Q2 signal to go high for one strobe cycle, as shown at K. Each time the Q1 signal goes high, the Q3 signal is inverted by flip-flop 223, so Q3 goes high together with Q1 at L in FIG. 20. These transitions of the Q3 signal cause corresponding transitions in the complementary E1 and E2 signals. The first rise of the E1 signal causes the Q4 signal to rise at M. The next rise of the E1 signal causes the Q5 signal to rise. When the E1 signal rises next, the Q4 signal falls. When the E1 signal rises again, the Q5 signal falls.

The W3 to W0 signals are write command pulses synchronized with the Q2 signal. Two W3 pulses are output at O and P, in synchronization with the first two Q2 pulses, followed by two W2 pulses, two W1 pulses, and two W0 pulses. Each pulse of the W3 to W0 signals causes data to be written into the MEM2 memory blocks in FIG. 8. The first W3, W2, W1, and W0 pulses write data into memory elements that store compensation data for the odd-numbered dots. The second W3, W2, W1, and W0 pulses write data into memory elements that store the compensation data for the even-numbered dots. The first W3, W2, W1, and W0 pulses are generated from the HD-STB-N signal inputs at A, C, E, and G; the second W3, W2, W1, and W0 pulses are generated from the HD-STB-N signal inputs at B, D, F, and H.

When all the four-bit compensation data have been stored, the HD-LOAD signal is brought low at Q, enabling the printing data transfer process to begin. As explained above, this process begins with a synchronization (HD-HSYNC-N) pulse R, followed by the transfer of data U for the odd-numbered dots into the shift register (FFA1 to FFD1, . . . , FFA24 to FFD24) and the latching of the data by the latch elements (LTA1 to LTD1, . . . , LTA24 to LTD24) in synchronization with a HD-LOAD pulse S. Then the strobe (HD-STB-N) signal goes low at W to drive the light-emitting thyristors, while the even-numbered dot data V are transferred into the shift register. After the odd-numbered light-emitting thyristors have been driven, the even-numbered dot data are latched by a HD-LOAD pulse T and the even-numbered light-emitting thyristors are strobed by a HD-STB-N pulse X.

As shown in FIG. 8, after passage through common push-pull buffer 123, the S1N signal output from the CTRL2 block 116 becomes the G1 signal that drives the gates of the odd-numbered light-emitting thyristors. After through passage through common push-pull buffer 124, the S2N signal output from the CTRL2 block 116 becomes the G2 signal that drives the gates of the even-numbered light-emitting thyristors. The gate driving signals G1 and G2 shown in FIG. 19 are therefore generated by the transitions of the S1N and S2N signals shown at a, b, c, and d in FIG. 20.

Figure 21:
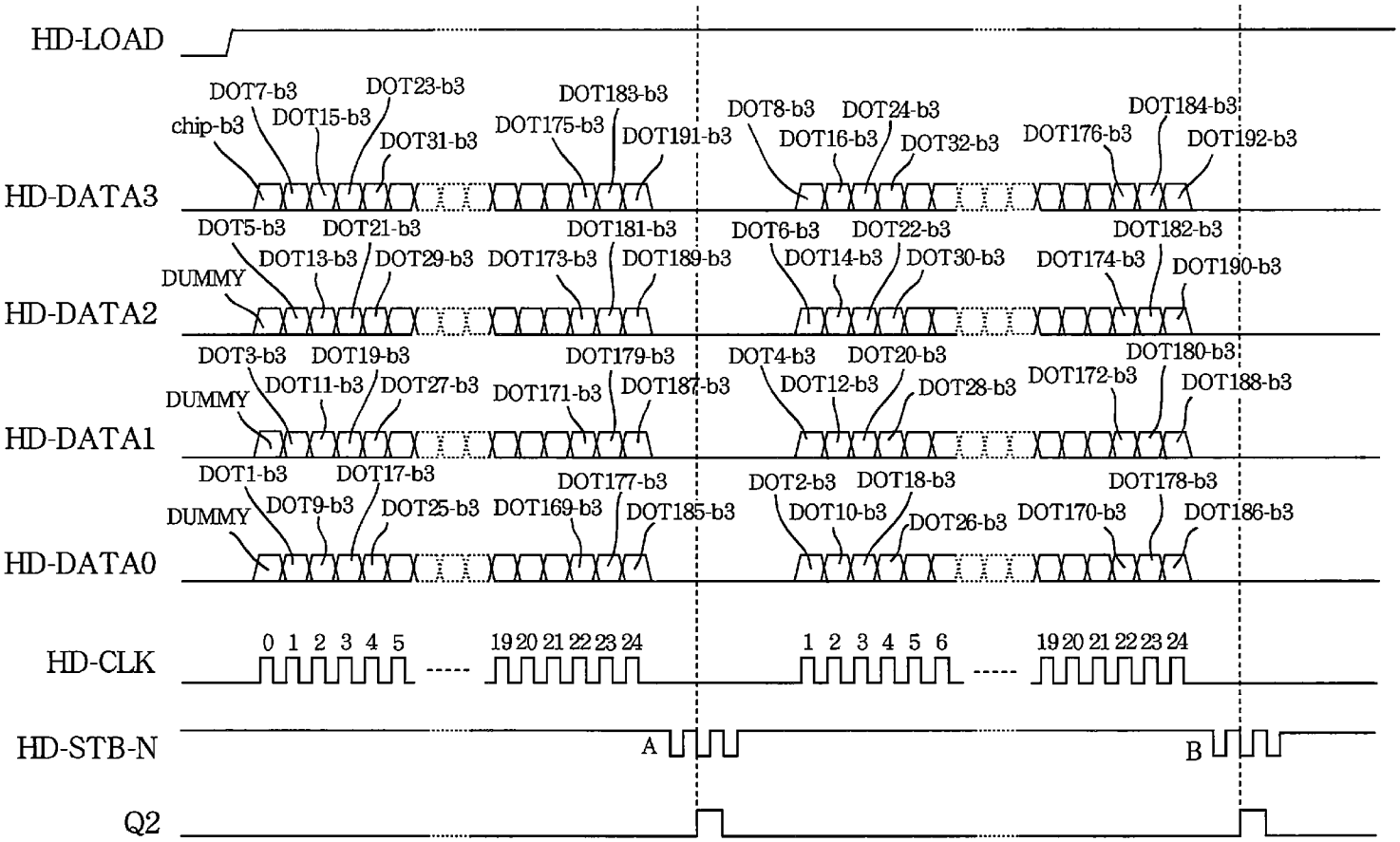
FIGS. 21, 22, 23, and 24 are detailed timing waveform diagrams illustrating the compensation data transfer process.
Figure 22:
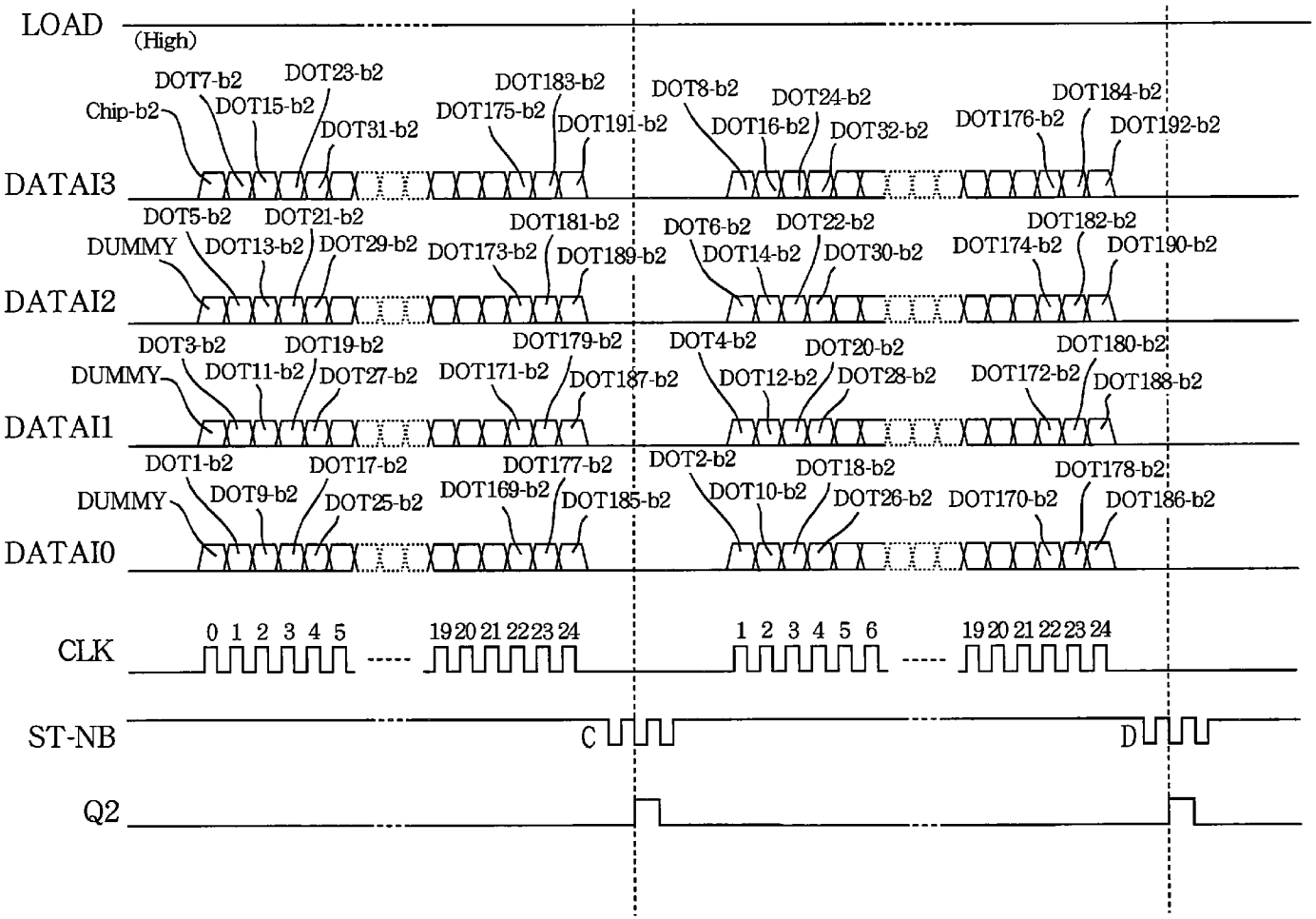
Figure 23:
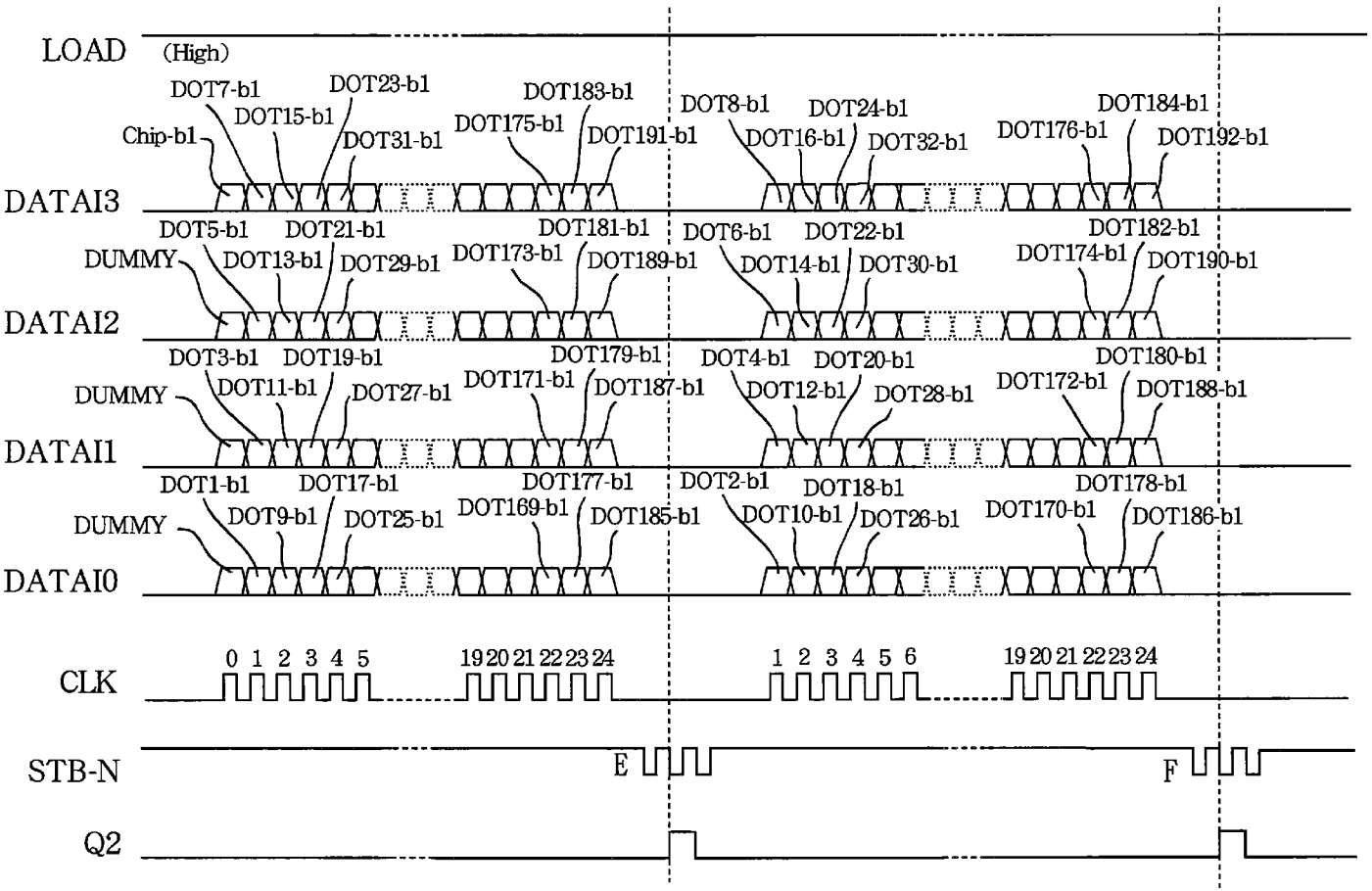
Figure 24:
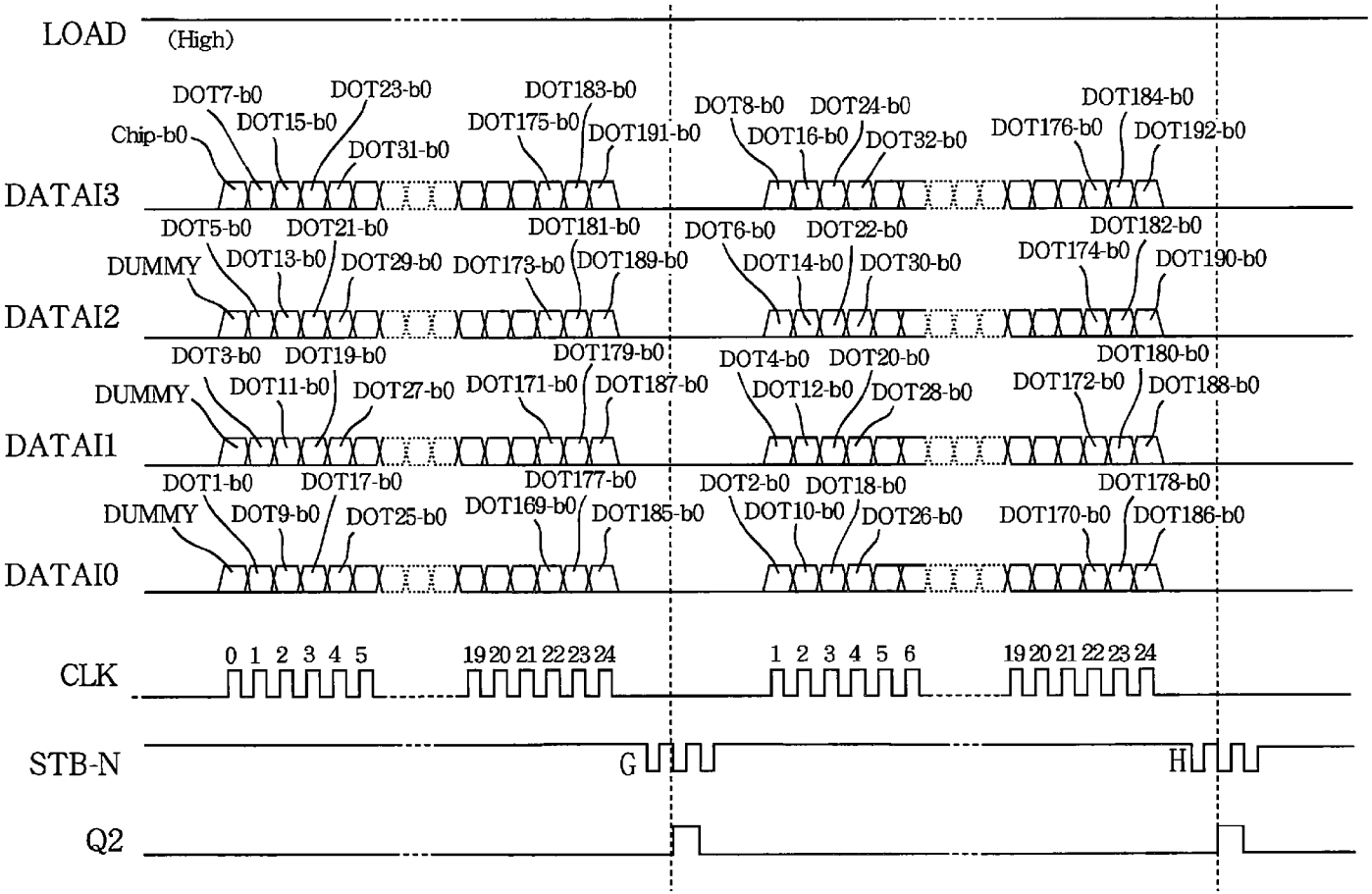

FIGS. 21 to 24 are detailed timing waveform diagrams illustrating the compensation data transfer process in FIG. 20. FIG. 21 shows details of the transfer of the most significant compensation data bits (b3). FIGS. 22, 23, and 24 show details of the transfer of the other bits (b2, b1, b0).

As explained above, the compensation data include both dot compensation data and chip compensation data. There are four bits of chip compensation data per driver IC. To enable the chip compensation data to be transferred together with the dot compensation data, the shift register has an extra stage in each driver IC (FFA25, FFB25, FFC25, FFD25 in FIG. 8). The four bits of chip compensation data may be transferred together with either the odd-numbered dot compensation data or the even-numbered dot compensation data, but it is convenient for each bit of chip compensation data to be transferred together with the corresponding bits of dot compensation data, e.g., for the most significant bit of chip compensation data to be transferred together with the most significant bits of dot compensation data. Accordingly, the chip compensation data bits (Chip-b3, Chip-b2, Chip-b1, Chip-b0) are transferred one by one as the first bits in the data strings in FIGS. 21 to 24, which are transferred in the intervals preceding A, C, E, and G in FIG. 20.

More specifically, the chip compensation data bits (Chip-b3, Chip-b2, Chip-b1, Chip-b0) are transferred as the first compensation bits on the HD-DATA-3 signal line, preceding the dot compensation data (DOT7-b3, DOT7-b2, DOT7-b1, DOT7-b0) for the seventh light-emitting thyristor. While the chip compensation data are being transferred on the HD-DATA-3 signal line, dummy data are transferred on the HD-DATA-2, HD-DATA-1, and HD-DATA-0 signal lines.

Figure 25:
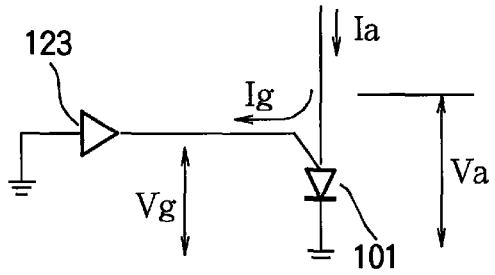
FIGS. 25 and 26 are circuit diagrams illustrating the operation of the light-emitting thyristor gate driving buffer circuits.
Figure 26:
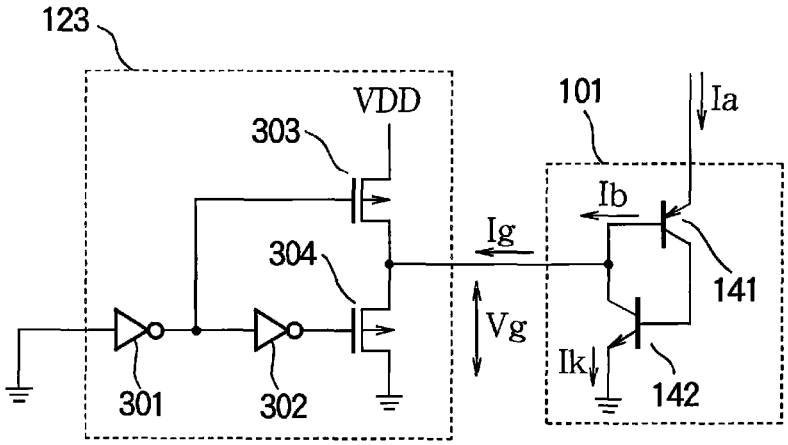

Next the operation of the common push-pull buffers 123 and 124 in FIG. 8 will be described. FIG. 25 schematically shows common buffer 123 and light-emitting thyristor 101, which is one of the light-emitting thyristors connected to common buffer 123. FIG. 26 shows the internal structure of common buffer 123 and an equivalent circuit of light-emitting thyristor 101. As also shown in FIG. 16, common buffer 123 includes a pair of inverters 301 and 302 and a pair of PMOS transistors 303 and 304. The equivalent circuit of light-emitting thyristor 101 includes a PNP transistor 141 and an NPN transistor 142.

The turn-on process of light-emitting thyristor 101 will be described with reference to FIGS. 25 and 26. First, to enable turn-on, the gate voltage of light-emitting thyristor 101 must be brought down, so the input of common push-pull buffer 123 goes low, causing the output of inverter 301 to go high and the output of inverter 302 to go low. This turns off PMOS transistor 303 and turns on PMOS transistor 304, the source voltage of which is lowered to a level about Vt higher than ground.

Then, to drive light-emitting thyristor 101, the driver IC supplies anode current Ia from the output terminal DO96 connected to light-emitting thyristor 101. This current flows forward through the PN junction between the anode and gate of light-emitting thyristor 101, or between the emitter and base of the PNP transistor 141, and exits from light-emitting thyristor 101 to common push-pull buffer 123 as gate current Ig. These currents also produce an anode voltage denoted Va and a gate voltage denoted Vg in FIGS. 25 and 26. The gate current Ig corresponds to the base current Ib of the PNP transistor 141 in light-emitting thyristor 101, shown in FIG. 26, so the flow of gate current Ig starts bringing PNP transistor 141 into the on state and generates collector current at the collector of PNP transistor 141. This collector current becomes the base current of NPN transistor 142, and brings NPN transistor 142 into the on state, allowing collector current or cathode current Ik to flow from the collector of NPN transistor 142 to the emitter of NPN transistor 142 and through the cathode terminal of light-emitting thyristor 101 to ground.

The collector current Ik augments the gate current Ig, thereby increasing the base current Ib of PNP transistor 141, and accelerates the transition of PNP transistor 141 into the on state. When NPN transistors 142 is fully turned on, its collector-emitter voltage becomes quite small, falling to a level lower than the threshold voltage Vt of PMOS transistor 304, so the current flow Ig from the gate of light-emitting thyristor 101 into common buffer 123 falls substantially to zero. Light-emitting thyristor 101 is now in its on state and its cathode current Ik is substantially equal to its anode current Ia.

Figure 27:
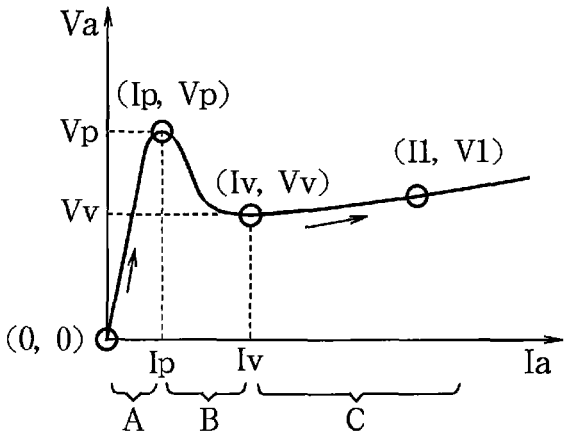
FIG. 27 is a graph illustrating the turning on of the light-emitting thyristors.

FIG. 27 illustrates the turn-on process of light-emitting thyristor 101 graphically. The horizontal axis represents the anode current Ia, and the vertical axis represents the anode voltage Va. Before light-emitting thyristor 101 is driven, its anode current and voltage are substantially zero, which corresponds to the origin (0, 0) of the graph. When the anode is driven, at first no current escapes from the cathode of light-emitting thyristor 101, and the anode voltage increases to Vp, as indicated by an arrow in the figure. Voltage Vp corresponds to the sum of the emitter-base voltage of PNP transistor 141 and the voltage Vt. The application of this forward voltage produces increasing gate current (equivalent to the base current of PNP transistor 141).

In FIG. 27, the point (Ip, Vp) at the peak of the current-voltage curve corresponds to the boundary between the off zone (A) and the on-transition zone (B) of light-emitting thyristor 101. At this point NPN transistor 142 begins conducting current to the cathode of light-emitting thyristor 101, allowing its anode current Ia to increase while its anode voltage Va decreases, and the operating point of light-emitting thyristor 101 moves down into a valley in the current-voltage curve. The point (Iv, Vv) at the bottom of this valley corresponds to the boundary between the on-transition zone (B) and the on zone (C) of light-emitting thyristor 101. At this point (Iv, Vv) the gate current Ig is reduced substantially to zero, and the buffer 123 is virtually isolated from light-emitting thyristor 101. Further increases in anode current Ia are accompanied by a slight increase in anode voltage Va, until the final operating point (I1, V1) is reached. The position of the final operating point depends on the amount of current (I1) supplied to the cathode of light-emitting thyristor 101 by the driver IC. Light-emitting thyristor 101 continues to emit light with corresponding optical power until the driver IC stops supplying cathode current, at which point light-emitting thyristor 101 turns off.

In the thyristor turn-on process described above, the common buffer 123 blocks the continuous drain of gate current from light-emitting thyristor 101 in the on state. In this state, in which the anode current Ia and cathode current Ik are substantially equal, the light emission power depends only on the anode current Ia, and can be adjusted by adjusting the compensation data in the driver IC to adjust the amount of anode current supplied.

This effect is due to the use of a PMOS-PMOS push-pull circuit as the output stage of the common buffers 123, 124. If an NMOS transistor were to be used instead of PMOS transistor 304, as in an ordinary complementary metal-oxide-semiconductor (CMOS) buffer, the low output level of the common buffers 123, 124 would be substantially 0 V, producing a continuing flow of gate current Ig, representing the base current of PNP transistor 141, into the common buffers. This current drain would detract from the cathode current Ik of light-emitting thyristor 101 and affect its light output. Moreover, the gate current Ig would vary due to extraneous factors, such as variations of the electrical characteristics of the NMOS transistors in the common buffers, causing dots of uneven size to be printed. Before the present invention, this problem made it difficult to implement an optical print head by using light-emitting thyristors.

If a PMOS-PMOS push-pull gate driving buffer is used as shown in FIG. 26, the above problem does not occur, and the light-emitting thyristor print head becomes practical, with the advantage of reduced size and cost because the conventional power MOS transistors (transistors 41 and 42 in FIG. 1) are eliminated.

Figure 28:
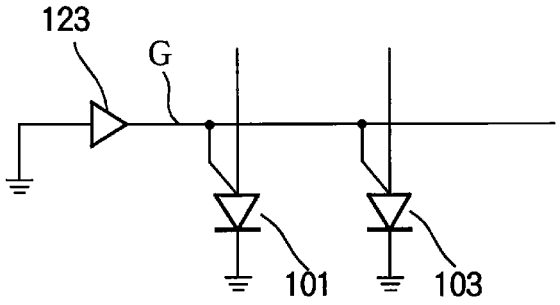
FIGS. 28 and 29 are circuit diagrams illustrating the operation when two light-emitting thyristors are turned on simultaneously.

Next the operation when multiple light-emitting thyristors receiving the same gate signal (G1 or G2 in FIG. 3) are driven simultaneously will be described. For simplicity, the driving of only two light-emitting thyristors 101 and 103 will be described. Both of these light-emitting thyristors are connected to common buffer 123 as shown in FIG. 28. The ground symbol attached to the input terminal of buffer 123 means that its input signal S2N is low to enable light-emitting thyristors 101, 103 to be driven. The gate bus line G is connected to the output terminal of buffer 123 and to the gates of both light-emitting thyristors 101 and 103.

Figure 29:
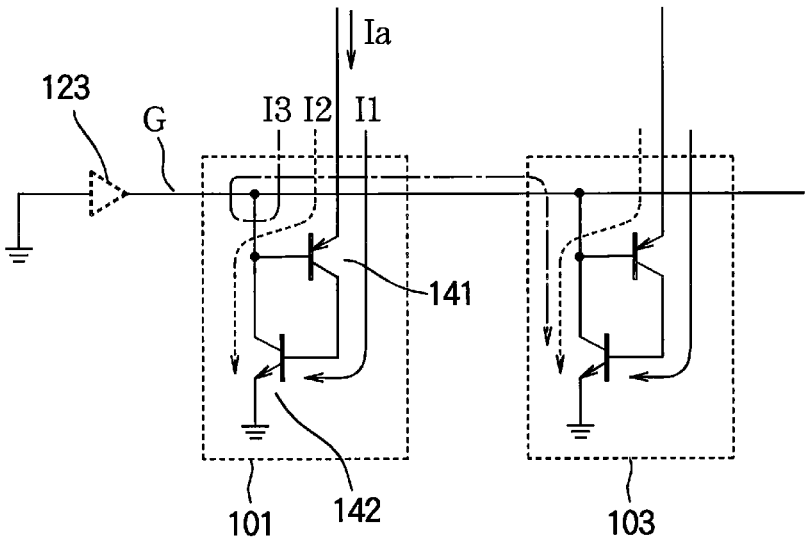

The internal equivalent circuits of light-emitting thyristors 101 and 103 are shown in FIG. 29, each including a PNP transistor 141 and an NPN transistors 142. In FIG. 29 light-emitting thyristors 101 and 103 are turned on simultaneously. As explained above, once light-emitting thyristors 101 and 103 are turned on, the flow of current on the gate bus line G from these light-emitting thyristors 101, 103 into the common push-pull buffer 123 is reduced to substantially zero, so buffer 123 is indicated by phantom lines in FIG. 29, as if the gate bus line G were open at this point.

When light-emitting thyristor 101 is turned on, its anode driving current Ia is the sum of three current components I1, I2, and I3. Current I1 flows from the anode through the emitter and collector of PNP transistor 141 and the base and emitter of NPN transistors 142 to ground, following the path indicated by the solid arrow. Current I2 flows from the anode through the emitter and base of PNP transistor 141 and the collector and emitter of NPN transistors 142 to ground, following the path indicated by the dashed arrow. Current I3 flows from the anode through the emitter and base of the PNP transistor 141, the gate terminal of light-emitting thyristor 101, the gate bus G, the gate terminal of light-emitting thyristor 103, and the collector and emitter of the NPN transistor in light-emitting thyristor 103 to ground, following the path indicated by the dash-dot arrow.

Light emission by the thyristor in the first embodiment is due primarily to the current flow through the PNP transistor 141. If the emitted optical power P is broken down into three components Pi1, Pi2, Pi3 assignable to respective current components I1, I2, and I3, the optical power components are related as follows:

$$Pi1>Pi2>>Pi3$$

If the current I3 flowing on the gate bus G between different light-emitting thyristors that are turned on simultaneously is sufficiently small, its effect on light emission becomes negligible; that is, Pi3 becomes negligible in comparison with Pi1 and Pi2. The light-emitting thyristors must, however, be structured so as to assure that I3 and Pi3 are sufficiently small. This requirement places restrictions on their optical and electrical characteristics and constrains the design of the light-emitting thyristors.

If necessary, steps can be taken to eliminate the flow of current I3 between the gates of different light-emitting thyristors, as described in the second and third embodiments.

In the first embodiment, conventional two-terminal LEDs are replaced by three-terminal light-emitting thyristors with gates driven by common PMOS-PMOS push-pull buffer circuits in the driver ICs. In the thyristor turn-on process, at first part of the anode driving current supplied to each driven light-emitting thyristor exits the thyristor through its gate terminal and the common buffer. After the light-emitting thyristor is turned on, however, current flow into the common buffer disappears, and the buffer is virtually isolated from the light-emitting thyristor. Accordingly, although the light-emitting thyristors are three-terminal elements, they can be driven in substantially the same way as two-terminal LEDs. That is, the light-emitting thyristor arrays in the first embodiment are substantially compatible with conventional LED driver ICs, requiring only minor modifications to replace the cathode drive (KDRV) signals in FIG. 1 with gate driving signals. Because the need for power MOS transistors (transistors 41 and 42 in FIG. 1) is eliminated, the electrophotographic print head can be implemented with a smaller circuit and at a lower cost than the conventional LED head.

Second Embodiment

Figure 30:
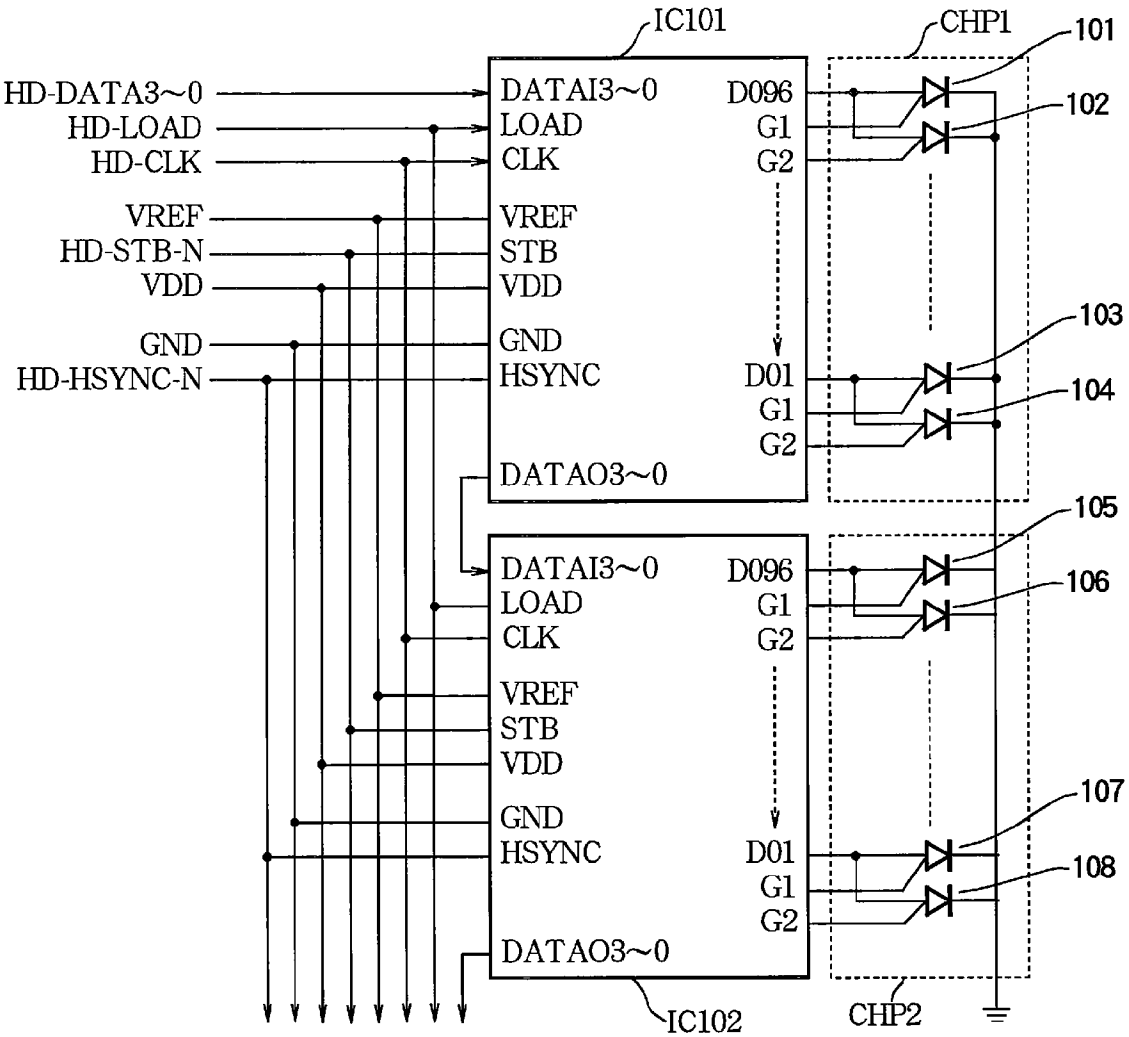
FIG. 30 is a circuit diagram showing the structure of the optical print head in a second embodiment.

FIG. 30 is a circuit diagram showing the structure of the optical print head in a second embodiment. The description below will again exemplify an optical print head capable of printing on A4 paper with a resolution of 600 dots per inch, having a total number of 4,992 light-emitting thyristors disposed in twenty-six array chips, each including 192 light-emitting thyristors. In the array chips, the cathodes of the odd-numbered light-emitting thyristors are grounded, the anodes of mutually adjacent pairs of light-emitting thyristors are interconnected, and the odd-numbered and even-numbered light-emitting thyristors are driven alternately, as in the first embodiment.

FIG. 30 shows the first two light-emitting thyristor array chips CHP1 and CHP2 and their driver ICs IC101 and IC102. The driver ICs are mutually identical and are connected in cascade. Each light-emitting thyristor array chip includes 192 light-emitting thyristor elements 101-108, each having an anode, cathode, and gate. The anodes of mutually adjacent pairs of light-emitting thyristors are interconnected and are connected to the anode driving terminals DO1 to DO96 of the corresponding driver IC. The cathodes of the light-emitting thyristors are grounded.

Differing from the first embodiment, none of the gates of the light-emitting thyristors are interconnected. Instead, the gates of the light-emitting thyristors are connected to separate gate-driving terminals G1 and G2 associated with each anode driving terminal of the driver ICs.

For example, the anodes of light-emitting thyristor 101 and light-emitting thyristor 102 are both connected to anode driving terminal DO96 of driver IC IC1. The gate of light-emitting thyristor 101 is connected to a terminal G1 disposed near anode driving terminal DO96. The gate of light-emitting thyristor 102 is connected to a terminal G2 likewise disposed near anode driving terminal DO96.

Similarly, the anodes of light-emitting thyristors 103 and 104 are both connected to anode driving terminal DO1 of driver IC IC1. The gate of light-emitting thyristor 103 is connected to a terminal G1 disposed near anode driving terminal DO1. The gate of light-emitting thyristor 104 is connected to a terminal G2 also disposed near anode driving terminal DO1.

As in the first embodiment, the driver ICs have data input terminals (DATAI3 to DATAI0) for receiving four-bit parallel print data signals (HD-DATA3 to HD-DATA0) in synchronization with a clock signal (HD-CLK) from a printing control unit (not shown). The four bits received with each clock pulse pertain to the four odd-numbered dots or four even-numbered dots in a group of eight consecutive dots. The driver ICs have internal flip-flops that form a shift register for holding data for 2,496 dots, and latch circuits into which the data are loaded from the shift register in synchronization with a latch signal (HD-LOAD).

The latched data are output in synchronization with a strobe signal (HD-STB-N) to drive the light-emitting thyristors in the light-emitting thyristor array chips with driving currents regulated by a reference voltage VREF received from a reference voltage generating circuit (not shown), and adjusted according to compensation data. A synchronizing signal HD-SYNC-N determines whether the even-numbered or odd-numbered light-emitting thyristors are driven. The driver ICs also have power supply (VDD) and ground (GND) terminals for receiving power.

Figure 31:
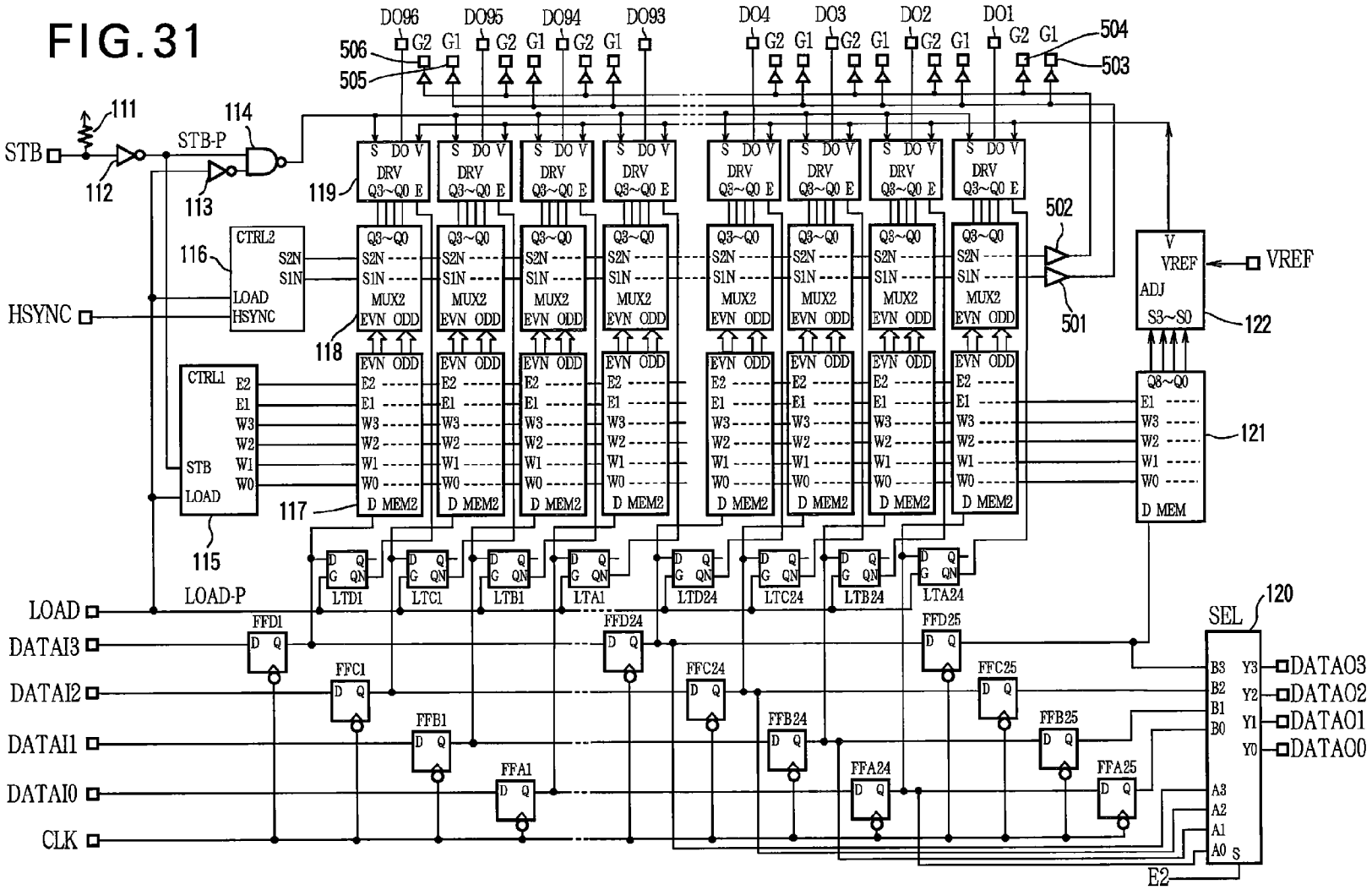
FIG. 31 is a block diagram showing the detailed structure of the driver ICs in the second embodiment.

FIG. 31 is a block diagram showing the detailed structure of the driver ICs in the second embodiment. As in the first embodiment, each driver IC includes: a pull-up resistor 111; a pair of inverters 112 and 113; a NAND circuit 114; flip-flops FFA1 to FFA25, FFB1 to FFB25, FFC1 to FFC25, and FFD1 to FFD25 interconnected to form a shift register; latch elements LTA1 to LTA24, LTB1 to LTB24, LTC1 to LTC24, and LTD1 to LTD24, forming a latch circuit; a pair of control circuit blocks 115, 116, denoted CTR1 and CTRL2; memory circuits organized as a MEM block 121 and twenty-four MEM2 blocks 117 to store compensation data; multiplexer (MUX2) circuit blocks 118 that select compensation data for odd-numbered or even-numbered dots; driving circuit (DRV) blocks 119; a selector (SEL) circuit 120; and a control voltage generator or ADJ block 122 that receives a reference voltage value VREF and supplies a control voltage to the driving circuit blocks 119.

The even-odd switching signals S1N and S2N output by the CTRL2 control circuit 116 are supplied to the multiplexer circuits MUX2 and to a pair of common buffers 501 and 502. The outputs of these common buffers 501, 502 are connected to further push-pull buffers 503, 504, 505, 506, which are connected individually to the G1 and G2 terminals of the driver IC. There is one push-pull buffer, e.g., push-pull buffer 503 or 505, for each G1 terminal and one push-pull buffer, e.g., push-pull buffer 504 or 506, for each G2 terminal. The gates of the light-emitting thyristors are driven individually by the push-pull buffers.

Flip-flops FFA1 to FFA25, FFB1 to FFB25, FFC1 to FFC25, and FFD1 to FFD25 are connected in cascade in the same way as in the first embodiment. The data input terminals D of flip-flops FFA1, FFB1, FFC1 and FFD1 are connected to the data input terminals DATAI0, DATAI1, DATAI2, and DATAI3 of the driver IC. The data output terminals of flip-flops FFA24 and FFA25, FFB24 and FFB25, FFC24 and FFC25, and FFD24 and FFD25 are connected to the selector circuit (SEL) 120. The output terminals Y0, Y1, Y2, and Y3 of the selector circuit 120 are connected to the data output terminals DATAO0, DATAO1, DATAO2, and DATAO3 of the driver IC. Flip-flops FFA1 to FFA25, FFB1 to FFB25, FFC1 to FFC25, and FFD1 to FFD25 form a four-bit-wide shift register with twenty-four or twenty-five stages, depending on the E2 input to the selector circuit 120. Since the data output terminals DATAO0 to DATAO3 of the driver IC are connected to the data input terminals DATAI0 to DATAI3 of the next driver IC, the flip-flops in driver ICs IC1 to IC26 form a (24×26)-stage or (25×26)-stage four-bit-wide shift register, depending on the state of the E2 signal.

The latch circuits LTA1 to LTA24, LTB1 to LTB24, LTC1 to LTC24, and LTD1 to LTD24 latch the outputs of the first twenty-four stages of the shift register in accordance with a latch signal LOAD-P as in the first embodiment. The latch signal LOAD-P and the strobe signal HD-STB-N control the strobing of the light-emitting thyristor driving blocks DRV as in the first embodiment.

Next the structure of the gate driving buffers in the second embodiment will be described.

The common buffers 501, 502 may be conventional push-pull buffers having a PMOS and NMOS transistor connected in series between the power supply VDD and ground as output elements. This structure (not shown) is similar to the structure in FIG. 16 except that inverter 302 is removed and PMOS transistor 304 is replaced by an NMOS transistor.

The push-pull buffers 503 to 506 that drive the gate terminals of the light-emitting thyristors all have the same structure, so only push-pull buffer 503 will be shown.

Figure 32:
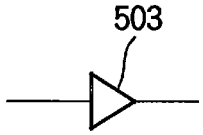
FIGS. 32 and 33 are circuit diagrams of the individual light-emitting thyristor gate driving buffer circuits in FIG. 31.
Figure 33:
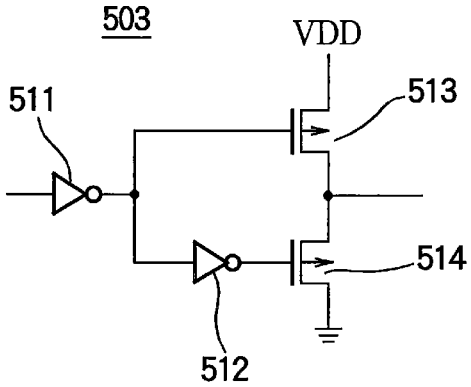

FIG. 32 shows the circuit symbol of push-pull buffer 503, and FIG. 33 shows one preferred circuit structure, similar to the structure in FIG. 16, comprising a pair of inverters 511, 512 and a pair of PMOS transistors 513, 514. The input terminal of inverter 511 is the input terminal of push-pull buffer 503. The output terminal of inverter 511 is connected to the input terminal of inverter 512 and the gate of PMOS transistor 513. The output terminal of inverter 512 is connected to the gate of PMOS transistor 514. PMOS transistor 513 has its source connected to the power supply VDD and its drain connected to the source of PMOS transistor 514 and the output terminal of the push-pull buffer. The drain of PMOS transistor 514 is grounded.

As in the first embodiment, PMOS transistor 514 operates as a self-opening switching element, turning off when the potential at the buffer output terminal differs by less than the PMOS transistor threshold voltage Vt from the ground level, but in the second embodiment the gate of each light-emitting thyristor is connected separately to ground through an individual self-opening switching element.

Figure 34:
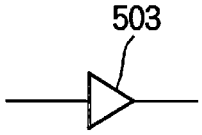
FIGS. 34 and 35 are circuit diagrams illustrating an alternate structure of the individual light-emitting thyristor gate driving buffer circuits in FIG. 31.
Figure 35:
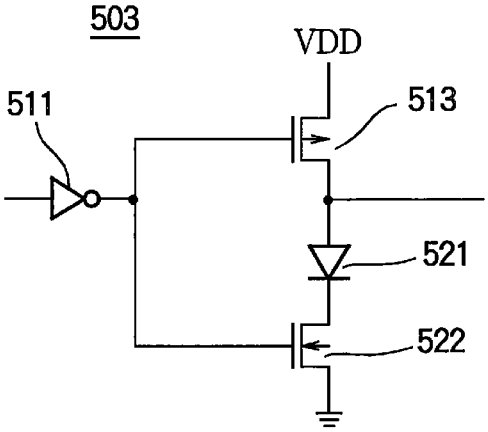

FIG. 34 again shows the circuit symbol of push-pull buffer 503, and FIG. 35 shows another preferred circuit structure, comprising an inverter 511, a PMOS transistor 513, a diode 521, and an NMOS transistor 522. The input terminal of the inverter 511 is the input terminal of push-pull buffer 503. The output of the inverter 511 is connected to the gates of PMOS transistor 513 and NMOS transistor 522. PMOS transistor 513 has its source connected to the power supply VDD and its drain connected to the output terminal of push-pull buffer 503 and the anode of the diode 521. The cathode of the diode 521 is connected to the drain of NMOS transistor 522. The source of NMOS transistor 522 is grounded. The circuit in FIG. 35 operates in substantially the same way as the circuit in FIG. 33 with the forward voltage Vf of the diode 521 in FIG. 35 playing the role of the threshold voltage Vt of PMOS transistor 514 in FIG. 33. The diode 521 operates as a self-opening switching element that turns off when the potential at the buffer output terminal differs by less than the diode forward voltage Vf from the ground level.

The difference between Vf and Vt produces a difference in operating characteristics between the push-pull buffers in FIGS. 33 and 35.

Figure 36A:
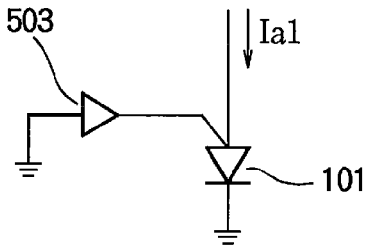
FIGS. 36A and 36B and FIGS. 37A and 37B are circuit diagrams illustrating the operation of the individual light-emitting thyristor gate driving buffer circuits in FIG. 31.
Figure 36B:
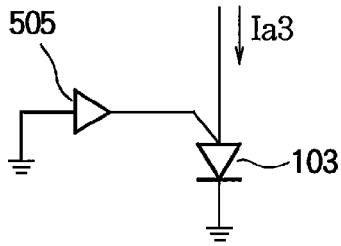
Figure 37A:
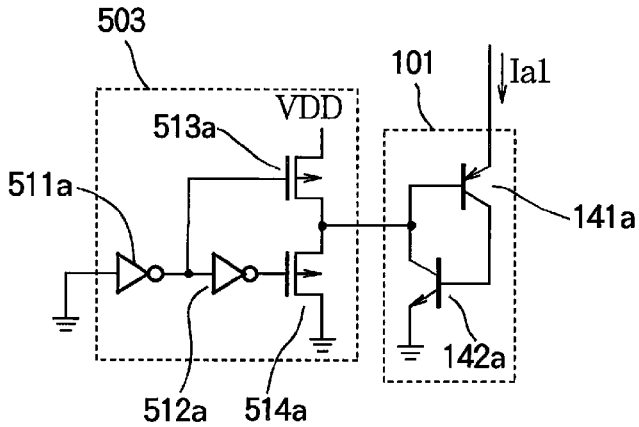
Figure 37B:
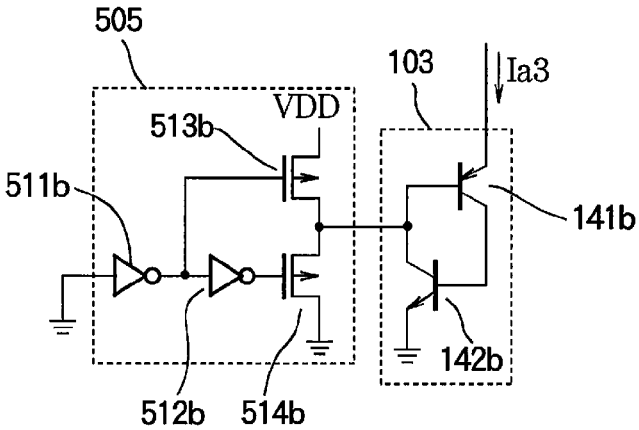

The operation of the second embodiment will now be described, using the buffer structure in FIG. 33. FIGS. 36A and 36B schematically show push-pull buffers 503 and 505 and the light-emitting thyristors 101 and 103 connected thereto, omitting the other buffers and thyristors to simplify the description. FIGS. 37A and 37B shows the internal structures of push-pull buffers 503 and 505 and equivalent circuits of light-emitting thyristors 101 and 103. The push-pull buffers 503, 505 include inverters 511*a*, 512*a*, 511*b*, 512*b* and PMOS transistors 513*a*, 514*a*, 513*b*, 514*b*; the equivalent circuits of light-emitting thyristors 101, 103 include PNP transistors 141*a*, 141*b* and NPN transistors 142*a*, 142*b*.

The turn-on process of light-emitting thyristor 101 will be described with reference to FIGS. 36A and 36B. If the input of push-pull buffer 503 is low, the output of inverter 511*a* is high and the output of inverter 512*a* is low, so PMOS transistor 513*a* is turned off and PMOS transistor 514*a* is turned on, and the source voltage of PMOS transistor 514*a* is lowered to a level about Vt higher than the ground, Vt being the PMOS transistor threshold voltage.

To drive light-emitting thyristor 101, the driver IC supplies anode current Ia1 to the anode of light-emitting thyristor 101. The anode current flows through the PN junction between the anode and gate of light-emitting thyristor 101. At first the current exits as gate current to push-pull buffer 503, but this gate current is also a base current of the PNP transistor 141*a* in light-emitting thyristor 101. The flow of base current causes PNP transistor 141*a* to start turning on and some of the anode current Ia1 becomes collector current, flowing from the collector of PNP transistor 141*a* to the base of NPN transistor 142*a*. The inflow of base current turns on NPN transistor 142*a*, enabling collector current to flow from NPN transistor 142*a* to ground. This collector current flow increases the base current of PNP transistor 141*a* and accelerates the transition of PNP transistor 141*a* to the on state. When the collector-emitter voltage decreases to a level lower than the threshold voltage Vt of PMOS transistor 514*a* in push-pull buffer 503, the gate current flowing from the gate of light-emitting thyristor 101 to the output terminal of push-pull buffer 503 is reduced to substantially zero and substantially all the anode current Ia1 leaves light-emitting thyristor 101 as cathode current, flowing from the cathode of light-emitting thyristor 101 to ground. Light-emitting thyristor 101 is now in the on state.

Push-pull buffer 505 and light-emitting thyristor 103 operate in the same way. The difference from the first embodiment is that even if light-emitting thyristor 101 and light-emitting thyristor 103 are driven simultaneously, no current flows between them, because they are connected to different gate wiring lines.

In the second embodiment, the light emission from a light-emitting thyristor is the sum of two components Pi1 and Pi2, where Pi1 is due to current flow through the collector of the equivalent PNP transistor and the base of the equivalent NPN transistor, and Pi2 is due to current flow through the base of the equivalent PNP transistor and the collector of the equivalent NPN transistor. Both of these currents enter the light-emitting thyristor at its anode (the emitter of the equivalent PNP transistor) and exit the light-emitting thyristor at its cathode (the emitter of the equivalent NPN transistor). Their sum is equal to the anode current of the light-emitting thyristor, which is substantially equal to its cathode current.

In the first embodiment there was an additional component Pi3 due to current flow between the gates of different light-emitting thyristors that were driven simultaneously, and this current was a potential source of minor variations in light emission, notwithstanding the relation Pi1>Pi2>>Pi3

In the second embodiment, since the Pi3 component is eliminated, more uniform light emission is obtained. In addition, the second embodiment removes the design constraints, which the above relationship imposed on the first embodiment.

Like the first embodiment, the second embodiment also reduces the size and cost of the electrophotographic print head by eliminating the need for large power MOS transistors (transistors 41 and 42 in FIG. 1) to select different groups of light-emitting elements.

In the second embodiment, the gates of the light-emitting thyristors are driven by individual buffer circuits with a PMOS-PMOS push-pull structure, or alternatively, a PMOS-diode-NMOS push-pull structure in which a diode is inserted between the PMOS and NMOS transistors. When the light-emitting thyristors are driven, these buffers pull the gate electrodes of the light-emitting thyristors down to a voltage substantially equal to the PMOS threshold voltage Vt or the diode forward voltage drop Vf, which is low enough to turn the light-emitting thyristors on but high enough so that once the light-emitting thyristors have been fully turned on, the flow of current from their gate electrodes into the buffer circuits is reduced substantially to zero. In addition, the use of a separate buffer for each light-emitting thyristor ensure that no current flows between the gate electrodes of different light-emitting thyristors. Accordingly, the light-emitting thyristors can be driven like two-terminal LEDs, and provide highly uniform light emission.

Third Embodiment

The third embodiment replaces the individual buffers of the second embodiment with individual pairs of cross-coupled diodes. In other respects, the structure of the optical print head in the third embodiment is the same as in the second embodiment.

Figure 38:
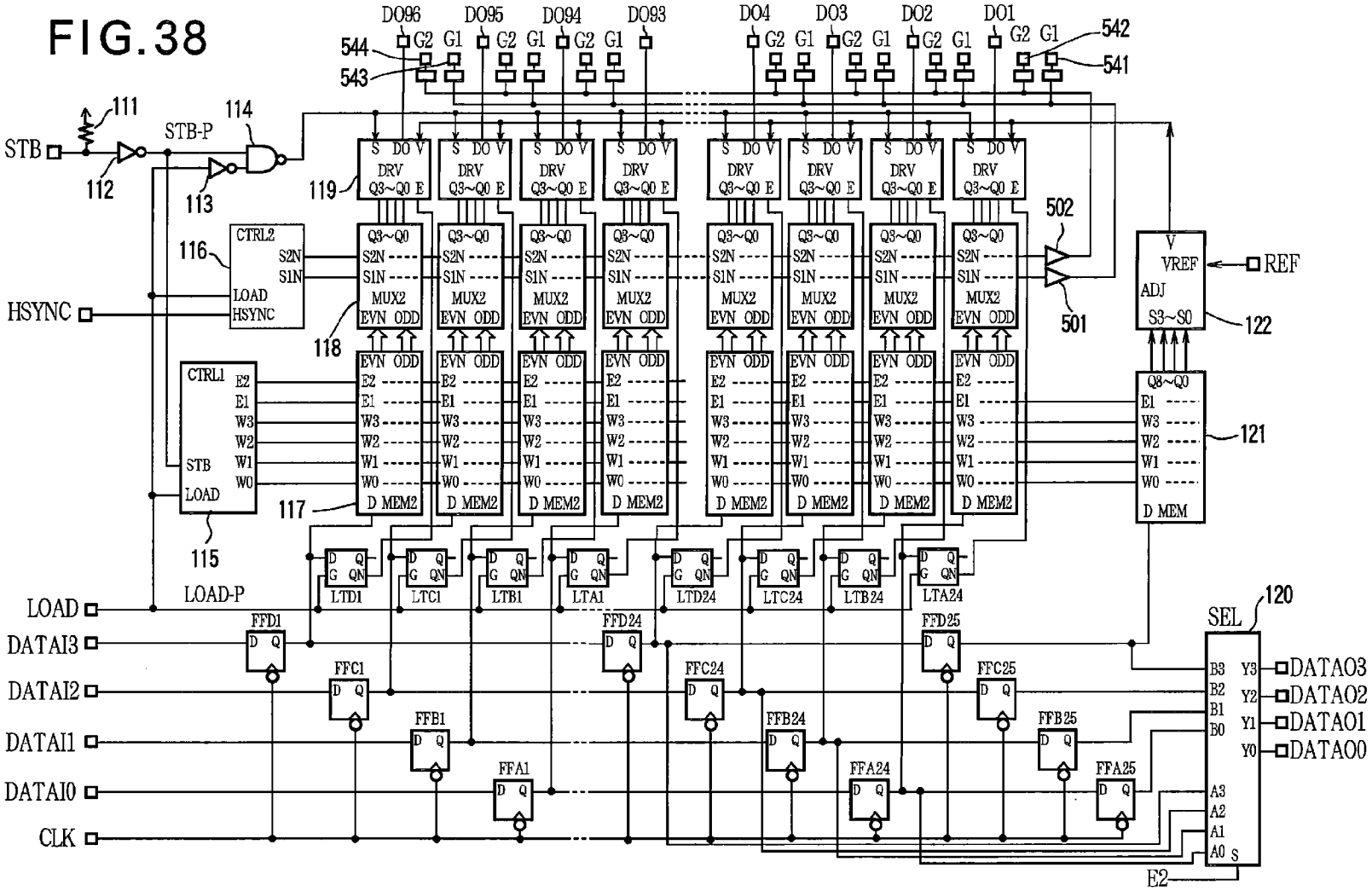
FIG. 38 is a block diagram showing the detailed structure of the driver ICs in a third embodiment.

Referring to FIG. 38, as in the second embodiment, each driver IC in the third embodiment includes: a pull-up resistor 111; a pair of inverters 112 and 113; a NAND circuit 114; flip-flops FFA1 to FFA25, FFB1 to FFB25, FFC1 to FFC25, and FFD1 to FFD25 interconnected to form a shift register; latch elements LTA1 to LTA24, LTB1 to LTB24, LTC1 to LTC24, and LTD1 to LTD24 forming a latch circuit; a pair of control circuit blocks 115, 116, denoted CTR1 and CTRL2; memory circuits organized as a MEM block 121 and twenty-four MEM2 blocks 117 to store compensation data; multiplexer circuits 118 that select compensation data for odd-numbered or even-numbered dots; driving circuit (DRV) blocks 119; a selector circuit 120; a control voltage generator or ADJ block 122 that receives a reference voltage value VREF and supplies a control voltage to the driving circuit blocks 119; and a pair of common buffers 501, 502.

In the third embodiment, the outputs of the common buffers 501, 502 are connected to diode circuits 541, 542, 543, 544, which are connected to the individual G1 and G2 terminals of the driver IC. Each light-emitting thyristor (not shown) is connected to one of the G1 or G2 terminals as in the second embodiment.

Next the structure of the diode circuits 541 to 544 will be described. All of these diode circuits have the same structure, so only diode circuit 541 will be described.

Figure 39:
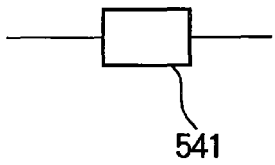
FIGS. 39 and 40 are circuit diagrams of the diode circuits in the third embodiment.
Figure 40:
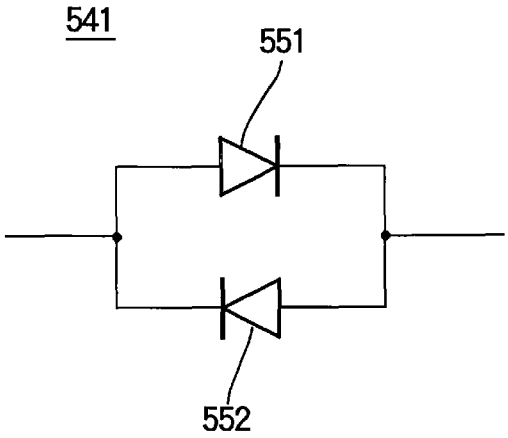

FIG. 39 shows the circuit symbol of diode circuit 541, and FIG. 40 shows its circuit structure, comprising a pair of cross-coupled diodes 551, 552. The anode of diode 551 is connected to the cathode of diode 552, and the cathode of diode 551 is connected to the anode of diode 552. The diodes 551 and 552 are thereby connected in parallel but with opposite polarity between a first node connected to the output terminal of one of the two common buffers (in this case, common buffer 501) and a second node connected to the gate terminal of one of the light-emitting thyristors (in this case, light-emitting thyristor 101).

When a voltage is applied across the nodes of the diode circuit 541, if the absolute value of the voltage exceeds the forward voltage Vf of the diodes 551, 552, forward current flows through one the two diodes. If the absolute value of the voltage is less than Vf, no current flows through either diode 551, 552. The diode circuit 541 therefore functions as a current switch that turns on when the voltage applied across it in either direction exceeds Vf, and turns off otherwise. If the high and low voltages applied to the diode circuit 541 by common buffer 501 or 502 are VDD and 0 V (ground), the diode circuit 541 can pull the gate electrode of the connected light-emitting thyristor up to a high level substantially equal to VDD−Vf or down to a low level substantially equal to Vf.

Figure 41:
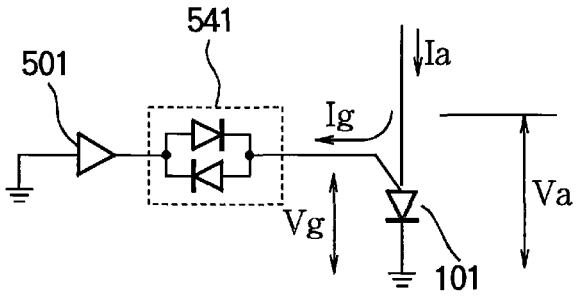
FIGS. 41 and 42 are circuit diagrams illustrating the operation of the diode circuits and the light-emitting thyristors in the third embodiment.
Figure 42:
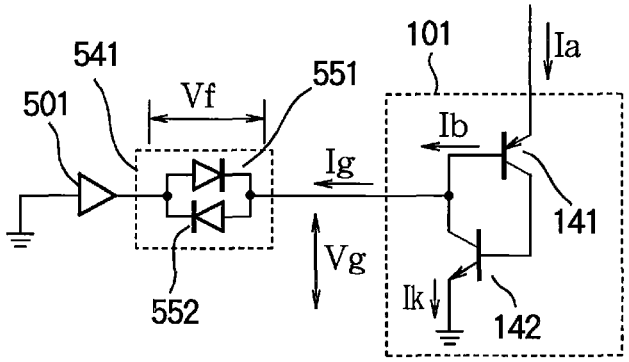

The operation in the third embodiment will now be described. FIG. 41 schematically shows common buffer 501 and diode circuit 541, and the light-emitting thyristor 101 connected to diode circuit 541. FIG. 42 schematically shows common buffer 501 and diode circuit 541 and the equivalent internal circuit structure of light-emitting thyristor 101, comprising a PNP transistor 141 and an NPN transistor 142. Also indicated in FIG. 42 are the forward voltage Vf of the diodes 551 and 552 in diode circuit 541, the base current Ib of PNP transistor 141, and the anode current Ia, gate current Ig, gate voltage Vg, and cathode current Ik of light-emitting thyristor 101.

The turn-on process of light-emitting thyristor 101 is substantially the same in the third embodiment as in the first and second embodiments. When the input to common buffer 501 is low, the output of common buffer 501 is low (0 V) and the output of diode circuit 541 is pulled down to substantially Vf, the forward voltage of diode 552. To drive light-emitting thyristor 101, the driver IC supplies anode current Ia to the anode of light-emitting thyristor 101. The anode current flows to the gate of light-emitting thyristor 101. At first the current exits as gate current Ig to diode circuit 541, flows through diode 552 in diode circuit 541, and then flows through common buffer 501 to ground. This gate current is also a base current that turns on PNP transistor 141 in light-emitting thyristor 101. As PNP transistor 141 turns on, some of the anode current Ia becomes collector current of PNP transistor 141 and base current of the NPN transistors 142. This current turns on NPN transistor 142, and the resultant flow of current through NPN transistor 142 to ground increases the base current of PNP transistor 141, accelerating the transition of PNP transistor 141 to the on state.

The gate voltage Vg of light-emitting thyristor 101 is also the collector-emitter voltage of NPN transistor 142. When NPN transistor 142 is fully turned on, this voltage Vg decreases to a level lower than the forward voltage Vf of diode 552 in diode circuit 541, the flow of current through diode 552 is reduced to substantially zero, and nearly all the anode current Ia leaves light-emitting thyristor 101 as cathode current Ik, flowing from the cathode of light-emitting thyristor 101 to ground. Light-emitting thyristor 101 is now in the on state.

Figure 43:
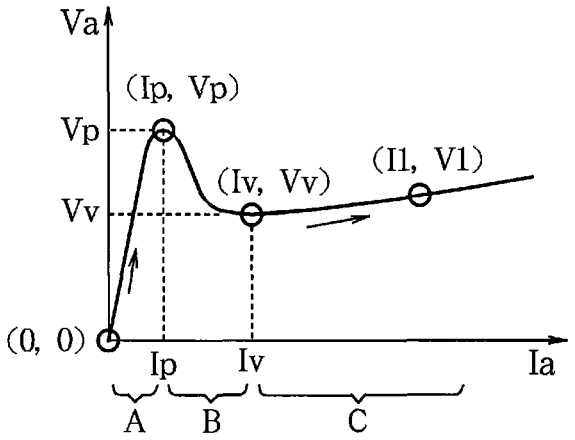
FIG. 43 is a graph illustrating the turning on of the light-emitting thyristors in the third embodiment.

FIG. 43 illustrates the turn-on process of light-emitting thyristor 101 graphically. The horizontal axis represents the anode current Ia, and the vertical axis represents the anode voltage Va. As in the first embodiment, when light-emitting thyristor 101 is not driven, its anode voltage and current are both substantially zero, corresponding to the origin point (0, 0) of the graph. When the driver IC begins supplying anode current, the anode voltage rises rapidly to Vp, which is now equal to the sum of the forward voltage of NMOS transistor 522 and the emitter-base voltage of the PNP transistor 141. During this voltage rise, light-emitting thyristor 101 is still in its off zone (A), so the anode current becomes gate current, which increases to a value Ip.

As the equivalent NPN transistor in light-emitting thyristor 101 turns on, light-emitting thyristor 101 moves into the on-transition zone (B) in FIG. 43, in which the anode current increases to a value Iv while the anode voltage falls to a value Vv such that the gate voltage of light-emitting thyristor 101 is below the forward voltage Vf of the diodes in diode circuit 541. The gate current of light-emitting thyristor 101 is now is reduced to substantially zero, and substantially all of the anode current flows to the cathode of light-emitting thyristor 101; light-emitting thyristor 101 is substantially isolated by diode circuit 541 from the common buffer 501. Light-emitting thyristor 101 then operates in its on zone (C), in which the anode current continues to increase, accompanied by a slight rise in anode voltage, until the operating point (I1, V1) is reached. Light-emitting thyristor 101 then continues to operate at this point, emitting an amount of light that depends on the current (I1) supplied from the driver IC.

In the final operating state of light-emitting thyristor 101, accordingly, diode circuit 541 blocks the flow of gate current to common buffer 501, so that the amount of light emitted by light-emitting thyristor 101 can be accurately controlled by the compensation data that adjust the anode current Ia supplied by the driver IC.

Figure 44:
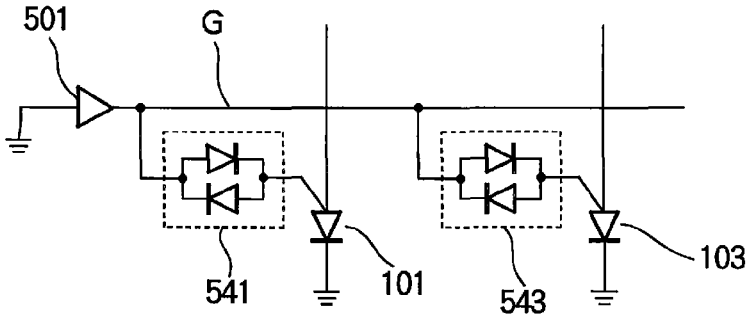
FIGS. 44 and 45 are circuit diagrams illustrating the operation when two light-emitting thyristors are turned on simultaneously.
Figure 45:
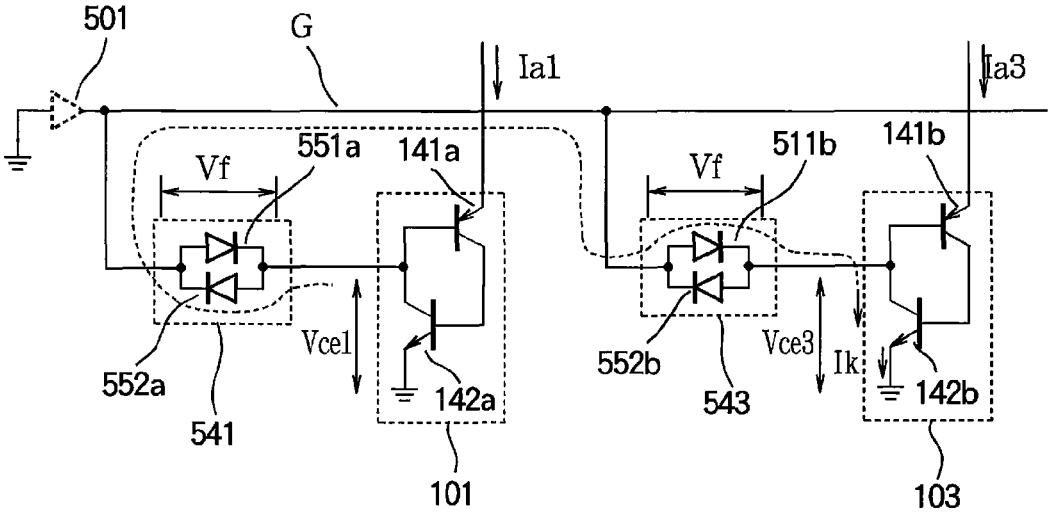

The operation of the third embodiment when light-emitting thyristors 101 and 103 are driven simultaneously will now be described. FIG. 44 shows these light-emitting thyristors, the diode circuits 541, 543 to which they are connected, and the common buffer 501 to which diode circuits 541 and 543 are connected. FIG. 45 indicates the equivalent internal circuit structure of the light-emitting thyristors 101, 103 and their anode currents Ia1, Ia3, as well as the collector-emitter voltage Vce1 of the NPN transistors 142*a* in light-emitting thyristor 101 and the collector-emitter voltage Vce3 of the NPN transistor 142*b* in light-emitting thyristor 103, and the cathode current Ik of light-emitting thyristor 103.

In FIG. 44, the input terminal of common buffer 501 is shown as connected to ground to indicate that its input is being driven to the low logic level to enable the driving of the odd-numbered light-emitting thyristors. The gate wiring G connects the output terminal of common buffer 501 to the diode circuits 541 and 543 connected to the gate terminals of light-emitting thyristors 101 and 103. In FIG. 45, anode currents Ia1 and Ia3 are supplied to drive light-emitting thyristors 101 and 103 simultaneously. As described above, once light-emitting thyristors 101, 103 have been turned on, the flow of current from their gate terminals through the diode circuits 541, 543 to common buffer 501 is reduced to substantially zero. In this state the effect of the common buffer 501 connected to the gate wiring G can be disregarded, so the common buffer 501 is drawn with phantom lines in FIG. 45.

While light-emitting thyristors 101 and 103 are in the process of turning on, there may be a transient period in which some current flows from the gate terminal of light-emitting thyristor 101 to the gate terminal of light-emitting thyristor 103, becoming part of the cathode current Ik of light-emitting thyristor 103. To reach ground, this current, indicated by the curved dotted line in FIG. 45, must pass through diode 552*a* in diode circuit 541 and diode 551*b* in diode circuit 543, as well as through NPN transistor 142*b*. Between the gate terminal of light-emitting thyristor 101 and the cathode of light-emitting thyristor 103, accordingly, there is a voltage drop Vg equal to $$Vg=2\times Vf+Vce3$$

For this current to flow, the collector-emitter voltage Vce1 of the NPN transistor 142*a* in light-emitting thyristor 101 must be equal to or greater than the above value. Once light-emitting thyristor 101 moves into the on zone (C) in FIG. 43, in which the collector-emitter voltage Vce1 of the NPN transistor 142*a* is less than Vf, this condition cannot be satisfied. In the on state, accordingly, no current can flow from the gate terminal of light-emitting thyristor 101 to the gate terminal of light-emitting thyristor 103. Similarly, no current can flow from the gate terminal of light-emitting thyristor 103 to the gate terminal of 101.

In the third embodiment, although the gate terminals of light-emitting thyristors 101 and 103 are interconnected through the gate wiring G and diode circuits 541 and 543, in the on state both diode circuits 541 and 543 are switched off, so no gate-to-gate current flows. As in the second embodiment, light emission from each light-emitting thyristor 101, 103 is the sum of two components Pi1 and Pi2, where Pi1 is due to current flow through the collector of the equivalent PNP transistor and the gate of the equivalent NPN transistor, and Pi2 is due to current flow through the base of the equivalent PNP transistor and the collector of the equivalent NPN transistor. The sum of these components accounts for substantially all of the anode current and cathode current of the light-emitting thyristor. There is no component Pi3 due to gate-to-gate current flow between light-emitting thyristors 101 and 103.

The third embodiment, like the second embodiment, removes the constraints on thyristor design that were necessary in the first embodiment to ensure that the condition $$Pi1>Pi2>>Pi3$$

was satisfied. The third embodiment also provides the other effects provided by the first and second embodiments: the conventional power MOS transistors (transistors 41 and 42 in FIG. 1) can be eliminated, reducing the size and cost of the electrophotographic print head; and once turned on, the light-emitting thyristors can be driven in the same way as the LEDs in an LED head.

Figure 46:
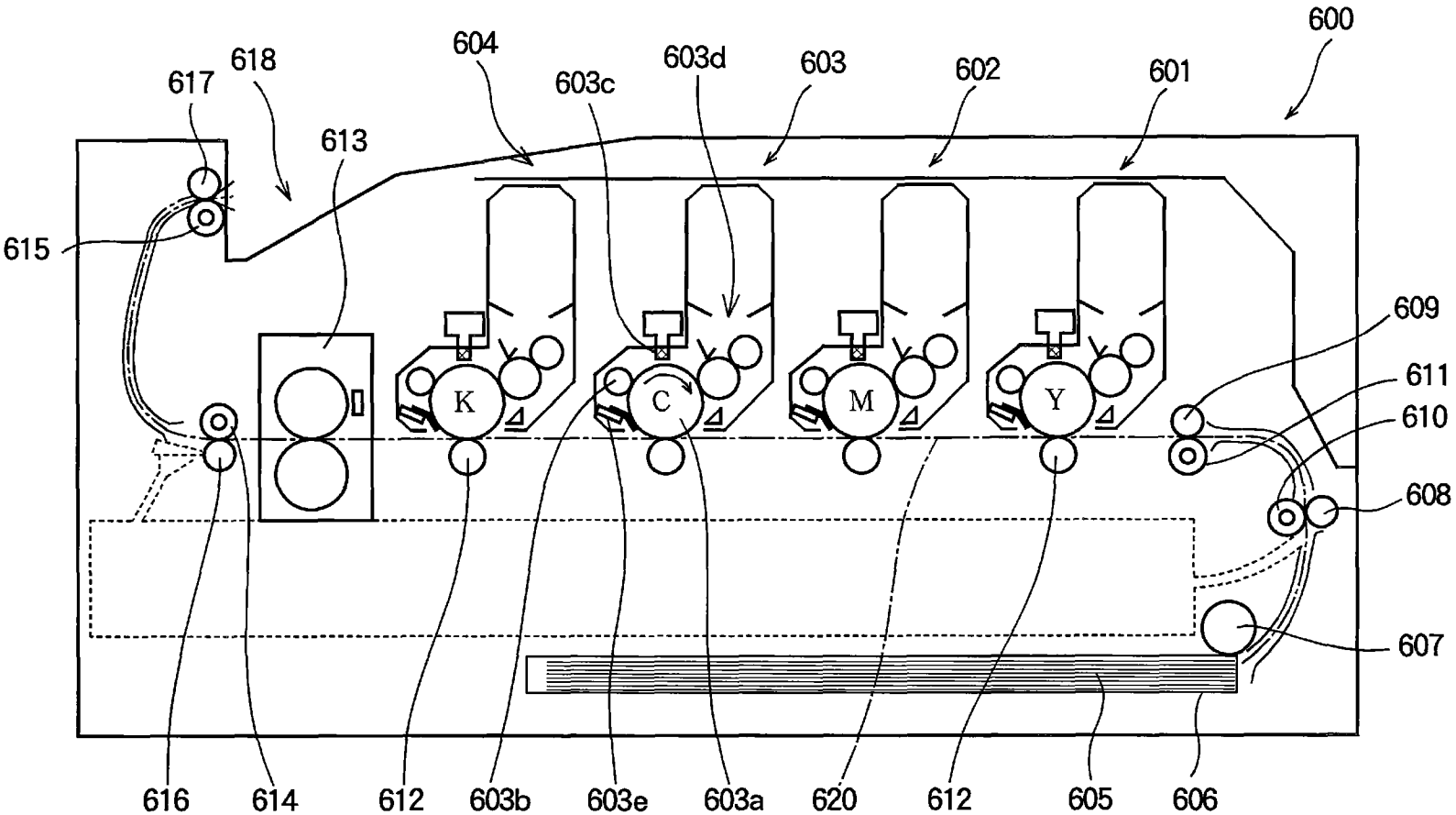
FIG. 46 is a schematic side view of a tandem color printer.

The electrophotographic print heads described in the preceding embodiments can be used in, for example, the tandem color printer illustrated in FIG. 46. This printer 600 includes process units 601 to 604 that print respective monochrome black (K), yellow (Y), magenta (M), and cyan (C) images. These units are placed one after another in the transport path of the recording medium 605. The process units 601 to 604 have the same internal structure. The internal structure of the cyan process unit 603 will be described as an example.

Process unit 603 includes a photosensitive drum 603*a* that turns in the direction indicated by the arrow. Disposed around the photosensitive drum 603*a* are a charger 603*b* for charging the surface of the photosensitive drum 603*a* by supplying electrical charge, a exposure unit 603*c* for forming a latent image by selectively illuminating the surface of the charged photosensitive drum 603*a*, a developing unit 603*d* for forming a toner image by applying cyan toner to the surface of the photosensitive drum 603*a* on which a latent image is formed, and a cleaning unit 603*e* for removing toner left after the toner image is transferred from the photosensitive drum 603*a*. The optical print head 19 described in any one of the preceding embodiments is used as the exposure unit 603*c*. The drums and rollers used in the process units are driven by a motor such as the develop/transfer process motor 3 in FIG. 2.

The printer 600 has at its bottom a paper cassette 606 for holding a stack of paper or other recording media 605. Disposed above the paper cassette 606 is a hopping roller 607 for taking sheets of the recording medium 605 separately from the paper cassette 606. Disposed downstream of the hopping roller 607 in the transport direction of the recording medium 605 are a pair of pinch rollers 608, 609, a transport roller 610 for transporting the recording medium 605 past pinch roller 608, and a registration roller 611 for transporting the recording medium 605 past pinch roller 609. The hopping roller 607, transport roller 610, and registration roller 611 are driven by a motor such as the paper transport motor 5 in FIG. 2.

Each of the process units 601 to 604 also includes a transfer roller 612, made of a semiconductive rubber or similar material, facing the photosensitive drum. A voltage applied to the transfer roller 612 creates an electrical potential difference between the surfaces of the photosensitive drum and the transfer roller 612. This potential difference transfers the toner image formed on the photosensitive drum onto the recording medium 605.

A fuser 613, which includes a heating roller and a backup roller, fuses the toner image onto the recording medium 605 by pressure and heat. A pair of delivery rollers 614 and 615 and a pair of pinch rollers 616 and 617 disposed downstream of the fuser 613 transport the recording medium 605 from the fuser 613 to a recording medium stacker 618. The delivery rollers are also driven by a motor and gears (not shown).

The operation of the tandem color printer 600 will be described briefly. The hopping roller 607 picks up the sheet at the top of the stack of recording medium 605 in the paper cassette 606. The recording medium 605 is carried between the transport roller 610 and pinch roller 608, aligned against the registration roller 611 and pinch roller 609, and then carried between the registration roller 611 and pinch roller 609 into the yellow process unit 601. As the recording medium 605 is transported between the photosensitive drum and transfer roller of process unit 601 by the rotation of its photosensitive drum, a yellow toner image is transferred onto the recording surface of the recording medium 605.

The recording medium 605 then passes through the other process units 602 to 604, which transfer magenta, cyan, and black toner images onto its recording surface. The toner images of all four colors are fused onto the recording medium 605 by the fuser 613 to form a full-color image, and the recording medium 605 is ejected by the delivery rollers 614 and 615 and their pinch rollers 616 and 617 onto the recording medium stacker 618 outside the printer 600.

An optical print head using light-emitting thyristors as in the present invention is not limited to use in printers of the type shown in FIG. 46. The present invention can be practiced in various types of image-forming apparatus, including copiers and multifunction printers. An optical print head using light-emitting thyristors as light-emitting elements provides high space efficiency, high optical efficiency, and high image quality. These advantages can be obtained in full-color image forming apparatus, monochrome image forming apparatus, and multiple-color image forming apparatus, but the greatest advantages can be obtained in full-color image forming apparatus with many optical printing heads.

Although the preceding embodiments employ light-emitting thyristors, the invention can also be practiced with other types of driven elements such as organic light-emitting diodes (OLEDs, also referred to as electroluminescent or EL elements) and resistive heating elements. For example, the invention can be applied to an electrophotographic printer having an OLED head, or to a thermal printer. The present invention can be also applied to an array of thyristors used as switching elements for driving arrays or matrices of display elements. The present invention can further be applied to a silicon controlled switch (SCS) array, which is similar to a thyristor array but in which each driven element is a four-terminal element with two gate terminals, a four-terminal element being treated as a type of three-terminal element.

Those skilled in the art will recognize that further variations are possible within the scope of the invention, which is defined in the appended claims.

What is claimed is:

1. A driving device using a first potential and a second potential to drive an array of three-terminal light-emitting elements, each three-terminal light-emitting element having a first terminal, a second terminal that receives the second potential, and a third terminal for enabling current flow between the first terminal and the second terminal, the three-terminal light-emitting elements being divided into a first group and a second group, the driving device comprising:

a plurality of switchable current sources associated with respective ones of the three-terminal light-emitting elements in each of the first and second groups, and receiving the first potential, for feeding current to the first terminals of the associated three-terminal light-emitting elements in each of the first and second groups; and a switching circuit for switchably connecting the third terminals of the three-terminal light-emitting elements to receive the first potential and the second potential, the switching circuit including a common first buffer and a common second buffer that are respectively associated with the first and second groups of the three-terminal light-emitting elements, wherein the first common buffer switches potentials at the third terminals of the three-terminal light-emitting elements in the first group simultaneously, and wherein the second common buffer switches potentials at the third terminals of the three-terminal light-emitting elements in the second group simultaneously.

2. The driving device of claim 1, wherein the switching circuit comprises a plurality of push-pull buffers associated with respective three-terminal light-emitting elements, and connected to the third terminals of the associated three-terminal light-emitting elements, each of the push-pull buffers separately including:

a first semiconductor switching element coupled to the third terminal of one of the three-terminal light-emitting elements and a conductor that receives the first potential, and a second semiconductor switching element coupled to the third terminal of said one of the three-terminal light-emitting elements and a conductor that receives the second potential;

wherein the first and second semiconductor switching elements are of identical semiconductor conductivity type;

wherein the first and second semiconductor switching elements of the push-pull buffers associated with the three-terminal light-emitting elements in the first group are controlled by the first common buffer; and wherein the first and second semiconductor switching elements of the push-pull buffers associated with the three-terminal light-emitting elements in the second group are controlled by the second common buffer.

3. The driving device of claim 2, wherein the first and second semiconductor switching elements are P-channel metal-oxide-semiconductor transistors.

4. The driving device of claim 1, wherein the switching circuit comprises a plurality of push-pull buffers associated with respective three-terminal light-emitting elements, and connected to the third terminals of the associated three-terminal light-emitting elements, each of the push-pull buffers separately including:

a first semiconductor switching element that receives the first potential and that is connected to a node connected to the third terminal of one of the three-terminal light-emitting elements;

a diode connected to the node; and a second semiconductor switching element connected to the diode and the second potential;

wherein the first semiconductor switching element, the diode, and the second semiconductor switching element are connected in series;

wherein the first and second semiconductor switching elements are of mutually opposite semiconductor conductivity type;

wherein the first and second semiconductor switching elements of the push-pull buffers associated with the three-terminal light-emitting elements in the first group are controlled by the first common buffer, and wherein the first and second semiconductor switching elements of the push-pull buffers associated with the three-terminal light-emitting elements in the second group are controlled by the second common buffer.

5. The driving device of claim 4, wherein the first semiconductor switching element is a P-channel metal-oxide-semiconductor transistor and the second semiconductor switching element is an N-channel metal-oxide-semiconductor transistor.

6. The driving device of claim 1, wherein the switching circuit comprises a plurality of pairs of cross-coupled diodes associated with respective three-terminal light-emitting elements, and, each pair of cross-coupled diodes is connected to the third terminal of the associated three-terminal light-emitting elements, the first common buffer being connected to the three-terminal light-emitting elements in the first group through the associated pairs of cross-coupled diodes, the second common buffer being connected to the three-terminal light-emitting elements in the second group through the associated pairs of cross-coupled diodes.

7. A driving device using a first potential and a second potential to drive an array of three-terminal light-emitting elements, each three-terminal light-emitting element having a first terminal, a second terminal that receives the second potential, and a third terminal for enabling current flow between the first terminal and the second terminal, the driving device comprising:

a plurality of switchable current sources that receive the first potential, for feeding current to the first terminals of the three-terminal light-emitting elements;

a switching circuit for switchably connecting the third terminals of the three-terminal light-emitting elements to the first potential and the second potential, the switching circuit including a common buffer that switches potentials at the third terminals of a plurality of the three-terminal light-emitting elements simultaneously; and a gate driving terminal to which the third terminals of the plurality of the three-terminal light-emitting elements are connected, wherein the common buffer includes:

a first semiconductor switching element coupled to the gate driving terminal and the first potential; and a second semiconductor switching element coupled to the gate driving terminal and the second potential, the first and second semiconductor switching elements being of identical semiconductor conductivity type.

8. The driving device of claim 7, wherein the first and second semiconductor switching elements are P-channel metal-oxide-semiconductor transistors.

9. An image forming apparatus using a first potential and a second potential, comprising:

an array of three-terminal light-emitting elements, each three-terminal light-emitting element having a first terminal, a second terminal that receives the second potential, and a third terminal for enabling current flow between the first terminal and the second terminal, the three-terminal light-emitting elements being divided into a first group and a second group; and a driving device for driving the array of three-terminal light-emitting elements;

wherein the driving device includes:

a plurality of switchable current sources associated with respective ones of the three-terminal light-emitting elements in each of the first and second groups, and receiving a first potential, for feeding current to the first terminals of the associated three-terminal light-emitting elements in each of the first and second groups, and a switching circuit for switchably connecting the third terminals of the three-terminal light-emitting elements to the first potential and the second potential, the switching circuit including a first common buffer and a second common buffer that are respectively associated with the first and second groups of the three-terminal light-emitting elements, wherein the first common buffer switches potentials at the third terminals of the three-terminal light-emitting elements in the first group simultaneously, and wherein the second common buffer switches potentials at the third terminals of the three-terminal light-emitting elements in the second group simultaneously.

10. The image forming apparatus of claim 9, further comprising:

a first gate driving terminal to which the third terminals of said plurality of the three-terminal light-emitting elements in the first group are connected, and a second gate driving terminal to which the third terminals of the plurality of the three-terminal light-emitting elements in the second group are connected, wherein the first gate driving terminal is connected to the common buffer, wherein the second gate driving terminal is connected to the second common buffer, wherein each of the first and second common buffers includes a self-opening switching element through which the associated gate driving terminal receives the second potential, and wherein the self-opening switching element switches off when the associated gate driving terminal is at a potential differing from the second potential by less than a predetermined amount.

11. The image forming apparatus of claim 9, further comprising:

a control voltage generating circuit for generating a control voltage intermediate between the first potential and the second potential;

a plurality of logic circuits powered by the first potential and the control voltage, for switching the switchable current sources on and off; and a multiplexer, powered by the first potential and the second potential, for controlling the plurality of logic circuits, the multiplexer including metal-oxide-semiconductor transistors of only a single semiconductor conductive type.

12. An image forming apparatus using a first potential and a second potential, comprising:

an array of three-terminal light-emitting elements, each three-terminal light-emitting element having a first terminal, a second terminal that receives the second potential, and a third terminal for enabling current flow between the first terminal and the second terminal;

a driving device for driving the array of three-terminal light-emitting elements, the driving device including a plurality of switchable current sources that receive the first potential, for feeding current to the first terminals of the three-terminal light-emitting elements, and a switching circuit for switchably connecting the third terminals of the three-terminal light-emitting elements to receive the first potential and the second potential, the switching circuit including a common buffer that switches potentials at the third terminals of a plurality of the three-terminal light-emitting elements simultaneously, and a plurality of self-opening switching elements through which the common buffer is connected to respective third terminals of said plurality of the three-terminal light-emitting elements, the self-opening switching elements switching off when the respective third terminals are at potentials differing from the second potential by less than a predetermined amount.

13. A circuit apparatus comprising:

a common bus;

an array of light-emitting elements, each light-emitting element including a three-terminal switching element, each switching element having a first terminal that receives a first potential, a second terminal that receives a second potential, and a third terminal connected to the common bus;

individual circuits associated with respective light-emitting elements, each comprising a pair of cross-coupled diodes, each of the individual circuits connecting the associated light-emitting element to the common bus; and a driver circuit driving the three-terminal switching elements of the array via the common bus.

14. The circuit apparatus of claim 13, wherein the pair of cross-coupled diodes has a first diode and a second diode, a cathode terminal of the first diode and an anode terminal of the second diode are mutually connected, and an anode terminal of the first diode and a cathode terminal of the second diode are mutually connected.

15. The circuit apparatus of claim 14, wherein the driving circuit is formed of a push-pull buffer.

16. The circuit apparatus of claim 15, wherein the push-pull buffer has first and second switching elements of a first conductivity type;

wherein a first terminal of the first switching element receives the first potential;

wherein a second terminal of the first switching element and a first terminal of the second switching element are mutually connected, and connected to the common bus; and wherein a second terminal of the second switching element receives the second potential.

* * * * *